US006196006B1

(12) United States Patent
Kawano et al.

(10) Patent No.: US 6,196,006 B1
(45) Date of Patent: Mar. 6, 2001

(54) PULSE TUBE REFRIGERATOR

(75) Inventors: Shin Kawano; Shaowei Zhu, both of Kariya; Masafumi Nogawa, Toyota; Tatsuo Inoue, Anjo, all of (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/320,646

(22) Filed: May 27, 1999

(30) Foreign Application Priority Data

May 27, 1998 (JP) ..... 10-146231
Jul. 30, 1998 (JP) ..... 10-216218

(51) Int. Cl.[7] ..... F25B 9/00
(52) U.S. Cl. ..... 62/6; 60/520
(58) Field of Search ..... 62/6; 60/520

(56) References Cited

U.S. PATENT DOCUMENTS 5,335,505 8/1994 Ohtani et al. ..... 62/6
5,515,685 5/1996 Yanai et al. ..... 62/6
5,522,223 6/1996 Yanai et al. ..... 62/6
5,647,218 * 7/1997 Kuriyama et al. ..... 62/6
5,701,742 * 12/1997 Eckels et al. ..... 62/51.1
5,701,743 * 12/1997 Hagiwara et al. ..... 62/6
5,711,156 * 1/1998 Matsui et al. ..... 62/6
5,813,235 * 9/1998 Peterson ..... 62/6
5,904,046 5/1999 Kawano ..... 62/6
5,974,807 * 11/1999 Gao et al. ..... 62/6

* cited by examiner

*Primary Examiner*—Ronald Capossela
(74) *Attorney, Agent, or Firm*—Oblon, Spivak, McClelland, Maier & Neustadt, P.C.

(57) ABSTRACT

A higher temperature end of a pulse tube is connected to a lower side of a supporting member so as to position at a lower temperature end of the pulse tube at a lower position. Such a structure prevents free convection of a working gas in the pulse tube, which is a cause of reduced refrigerating efficiency. If a cold head is desired to be contacted with a member to be cooled down from its (lower) side, such a need can be satisfied by mounting the cold head on the lower temperature end of the pulse tube (a lower temperature end of a regenerator).

25 Claims, 16 Drawing Sheets

PULSE TUBE REFRIGERATOR

BACKGROUND OF THE INVENTION

1. Field of the Invention

The present invention is directed to a pulse tube refrigerator and in particular to a pulse tube refrigerator for cooling a specific device below a temperature, which can be connected thereto in easier manner and with improved refrigerating efficiency.

2. Discussion of the Background

A conventional pulse tube refrigerator is disclosed in U.S. Pat. No. 5,515,685. Similar pulse regenerators are also disclosed in U.S. Pat. No. 5,522,223 and U.S. Pat. No. 5,335,505.

The conventional pulse tube refrigerator includes a pulse tube and a regenerator arranged in parallel thereto in such a manner that lower temperature ends of the pulse tube and the regenerator are in fluid communication with each other. The lower temperature ends of the pulse tube and the regenerator are mounted with a common cold head. The cold head is brought into contact with a member for cooling the same to a determined temperature in such a manner that coldness or an ultra low temperature generated at the lower temperature end of the pulse tube is transferred via the cold head to the member.

In the foregoing structure, a high or higher temperature end and a lower temperature end of each of the pulse tube and the regenerator, both of which extend in the downward direction, take higher and lower position, respectively. This means that the contact of the cold head with the member is established from the top thereof.

On the other hand, it is required to contact the cold head of the pulse tube refrigerator with the member to be cooled down from the bottom or a horizontal side thereof. In order to comply with such a need, it has been considered to establish such a connection after inverting the device or tipping the device down.

However, such an idea is not acceptable from a practical viewpoint. In detail, inverting the pulse tube refrigerator produces a higher position of the lower temperature end of the pulse tube and a lower position of the higher temperature end of the pulse tube, resulting in an occurrence of free convection of the working gas in the pulse tube. This free convection causes a movement of a higher temperature fluid at the higher temperature end to the lower temperature end and therefore such a heat movement acts as a heat load on the cold head. Thus, the resultant heat load on the cold head drops the refrigerating efficiency of the pulse tube refrigerator. Tipping the pulse tube refrigerator down makes a horizontal extension of the pulse tube. In the resultant condition, a temperature distribution of the working gas is disturbed in the pulse tube which disturbs a designed speed of the working gas in the pulse tube, resulting in that the refrigerating efficiency of the pulse tube refrigerator drops inevitably.

SUMMARY OF THE INVENTION

Therefore, in view of the foregoing circumstances, the present invention is intended to provide a pulse tube refrigerator which can be connected to a specific member to be cooled from any side without dropping the refrigerating efficiency.

In order to attain the foregoing objects, a pulse tube refrigerator includes a supporting member having an upper side and a lower side, respectively; a pulse tube having at opposite ends thereof a first higher temperature end connected to the lower side of the higher temperature end and a first lower temperature end, respectively; a regenerator having at opposite ends thereof a second temperature end connected to the upper side of the supporting member and a second lower temperature end; a connecting pipe connected between the first lower temperature end of the pulse tube and the second higher temperature end of the regenerator; a pressure oscillation device oscillating a working gas filled in a system between the pulse tube and the regenerator; a phase difference controller controlling a phase difference between a pressure oscillation and a displacement of the working gas; and a cold head disposed at one of the first higher temperature end of the pulse tube and the second lower temperature end of the regenerator.

BRIEF DESCRIPTION OF THE DRAWINGS

The above and other objects, features and advantages of the present invention will be more apparent and more readily appreciated from the following detailed description of preferred exemplary embodiments of the present invention, taken in connection with the accompanying drawings, in which.

DETAILED DESCRIPTION OF THE PRESENT INVENTION

Figure 1:
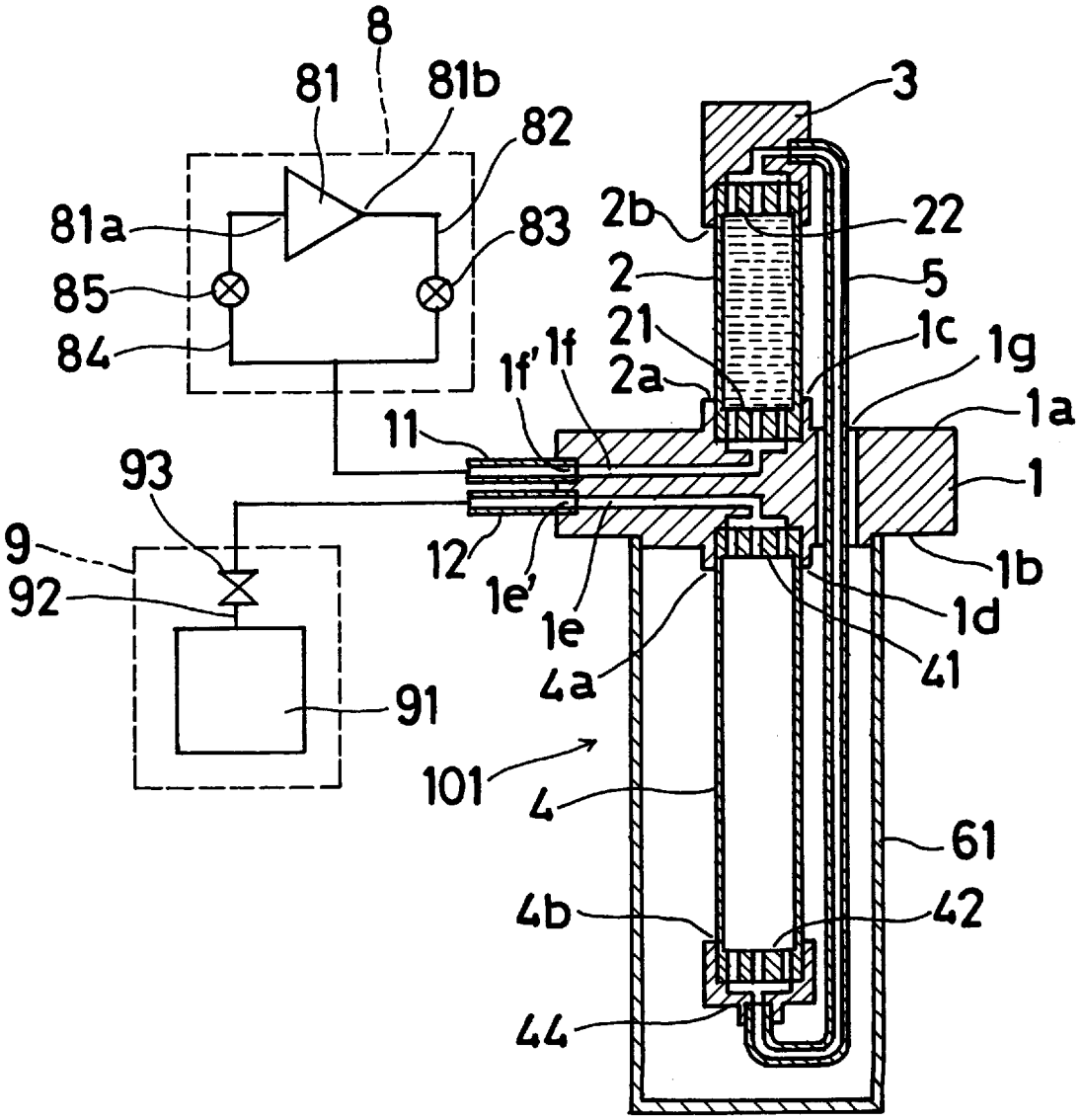
FIG. 1 is a partial vertical cross-sectional view of a first embodiment of a pulse tube refrigerator in accordance with the present invention.

Preferred embodiments of the present invention will be described hereinafter in detail with reference to the accompanying drawings.

It is to be noted that an arrow indicated in each FIG. denotes the direction of gravity.

First Embodiment

Referring first to FIGS. 1 to 4 inclusive, a pulse tube refrigerator 101 includes, as its principal elements or parts, a supporting member 1, pulse tube 4, a regenerator 2, a pressure oscillation device 8, a phase difference controller 9 and a connecting pipe 5.

The supporting member 1 is an annular member having an upper side 1*a* and a lower side 1*b*, and is formed of one of copper, brass, stainless steel and similar good thermal conductive metal. The upper side 1*a* and the lower side 1*b* of the supporting member 1 are provided therein with a concave portion 1*c* for receiving a lower end of the regenerator 2 and a concave portion for receiving an upper end of the pulse tube 4, respectively. Within the supporting member 1, there are provided a pulse tube passage 1*e* and a regenerator passage 1*f*. One end of the pulse tube passage 1*e* is in fluid communication with a bottom of the concave portion 1*d*, while the other end of the pulse tube passage 1*e* terminates in an open end at a left side of the supporting member 1. One end of the regenerator passage 1*f* is in fluid communication with a bottom of the concave portion 1*c*, while the other end of the regenerator passage 1*f* terminates in an open end 1*f*' at the left side of the supporting member 1. The supporting member 1 is also formed therein with a passing-through hole 1*g*.

The pulse tube 4 is configured to constitute a hollow cylindrical member having at opposite ends thereof a first higher temperature end 4*a* and a first lower temperature end 4*b*. At the first higher temperature end 4*a* and the first lower temperature end 4*b*, there are provided a first flow adjuster 41 and a second adjuster 42, respectively. The pulse tube 4 is held by the supporting member 1 such that the first higher temperature end 4*a* is fitted in the concave portion 1*d* so as to establish a downward extension of the pulse tube 4.

The regenerator 2 is formed into a hollow cylindrical body having at its opposite ends a second higher temperature end 2*a* and a second lower temperature end 2*b*. Within the cylindrical body, there is provide a heat-retaining member which is in the form of a plurality of stacked meshed metal sheets of stainless steel. Like the pulse tube 4, the regenerator 2 is provided at its ends 2*a* and 2*b* with flow adjusters 21 and 22, respectively. The regenerator 2 is held by the supporting member 1 such that the second higher temperature end 2*a* is fitted in the concave portion 1*e* so as to establish an upward extension of the regenerator 2.

The regenerator passage 1*f* formed in the supporting member 1 is, as mentioned above, in fluid communication at its one end with the concave portion 1*c*, while the other end is terminates in the open end 1*f*' at the left side of the supporting member 1. The open end 1*f*' is connected with one end of a pipe 11 whose the other end is connected to the pressure oscillation device 8.

In this embodiment, the pressure oscillation device 8 includes, as its major components, a compressor 81 which operates for discharging an operating fluid or gas under a higher pressure from an outlet port 81*b* after sucking an operating fluid or gas under a lower pressure from an inlet port 81*a*, a higher pressure pipe 82 connected at one end thereof to the outlet port 81*b* of the compressor 81, a higher pressure valve 83 provided in a midway of the pipe 82, a lower pressure pipe 84 connected at one end thereof to the inlet port 81*a* of the compressor 81, and a lower pressure valve 85 provided in a midway of the pipe 84. The other end of the higher pressure pipe 82 and the other end of the lower pressure pipe 84 join together, and the resultant junction is in fluid communication with the other end of the pipe 11. The higher pressure valve 83 and the lower pressure valve 85 are controlled to operate in opposition to each other and therefore when the higher pressure valve 83 and the lower pressure valve 85 are opened and closed, respectively, the higher pressure pipe 82 is in fluid communication with the pressure oscillation device 8, while when the higher pressure valve 83 and the lower pressure valve 85 are closed and opened, respectively, the lower pressure pipe 84 is in fluid communication with the pressure oscillation device 8.

The passage 1*e* formed in the supporting member 1 is, as previously mentioned, at its one end in fluid communication with the concave portion 1*d*. The other end of the passage 1*e* which terminates in the open end 1*e*' is in fluid communication with one end of a pipe 12 whose the other end is in fluid communication with the phase difference controller 9.

In this embodiment, the phase difference controller 9 includes, as its major components, a buffer tank 91 for storing a large amount of working gas by keeping the same at a determined pressure, a connecting pipe 92 whose one end is in fluid communication with the buffer tank 91, and an orifice 93 disposed between the connecting pipe 92 and the pipe 12. The orifice 93 offers a fluid restriction to the working gas which moves between an interior of the pulse tube 4 and the buffer tank 91 due to a pressure difference therebetween, which results in a phase difference between a pressure oscillation and a displacement of the working gas. Such a phase difference is adjusted or optimized in order to generated coldness or a ultra low temperature.

The first lower temperature end 4*b* of the pulse tube 4 and the second lower temperature end 2*b* of the regenerator 2*b* are connected to each other by the pipe 5. The diameter of the pipe 5 is set to be smaller than the diameter of the hole 1*g* formed in the supporting member 1 so as to permit extension of the pipe 5 through the hole 1*g* without contact therebetween. The reason is that such a contact therebetween brings about a heat transfer from the supporting member 1 to the pipe 5 which causes an extreme lowering the refrigerating efficiency.

The second lower temperature end 2*b* of the regenerator 2 is coupled with a cold head 3 which serves for transmitting coldness or an ultra low temperature generated thereat to a member to be cooled below a temperature. For excellent heat transfer, the cold head 3 is formed of copper which is of high thermal conductivity. Such a mounting structure of the cold head 3 on the second lower temperature end 2*b* of the regenerator 2 means that the cold head 3 is placed or located at the highest position of the pulse tube refrigerator 101.

The supporting member 1 is equipped at its lower side with a vacuum heat insulating casing 61 so as to enclose therein the pulse tube 4, the passage 1*g*, and the pipe 5. A vacuum condition within the casing 61 is established after mounting the same to the lower side of the supporting member 1 and such a condition prevents a heat entrance to the casing 61 from its outside.

In operation, when the higher pressure valve 83 and the lower pressure valve 85 make repetitive operations in opposition as previously mentioned while the compressor 81 of the pressure oscillation device 8 runs, a pressure oscillation occurs in the working gas of a pulse refrigerating system constituted by the pipe 1*f*, the regenerator 2, the connecting pipe 5, the pulse tube 4, and the pipe 1*e*. A phase difference is established between the pressure oscillation and the displacement of the working gas due to the flow restriction at the orifice 93 while the working gas is in reciprocal movement between the buffer tank 91 of the phase difference controller 9 and the pulse refrigerating system. Optimizing the phase difference by controlling the orifice 93 causes an adiabatic expansion of the working gas in the vicinity of the first lower temperature end 4*b*, which results in the generation of coldness or a ultra low temperature.

Figure 2:
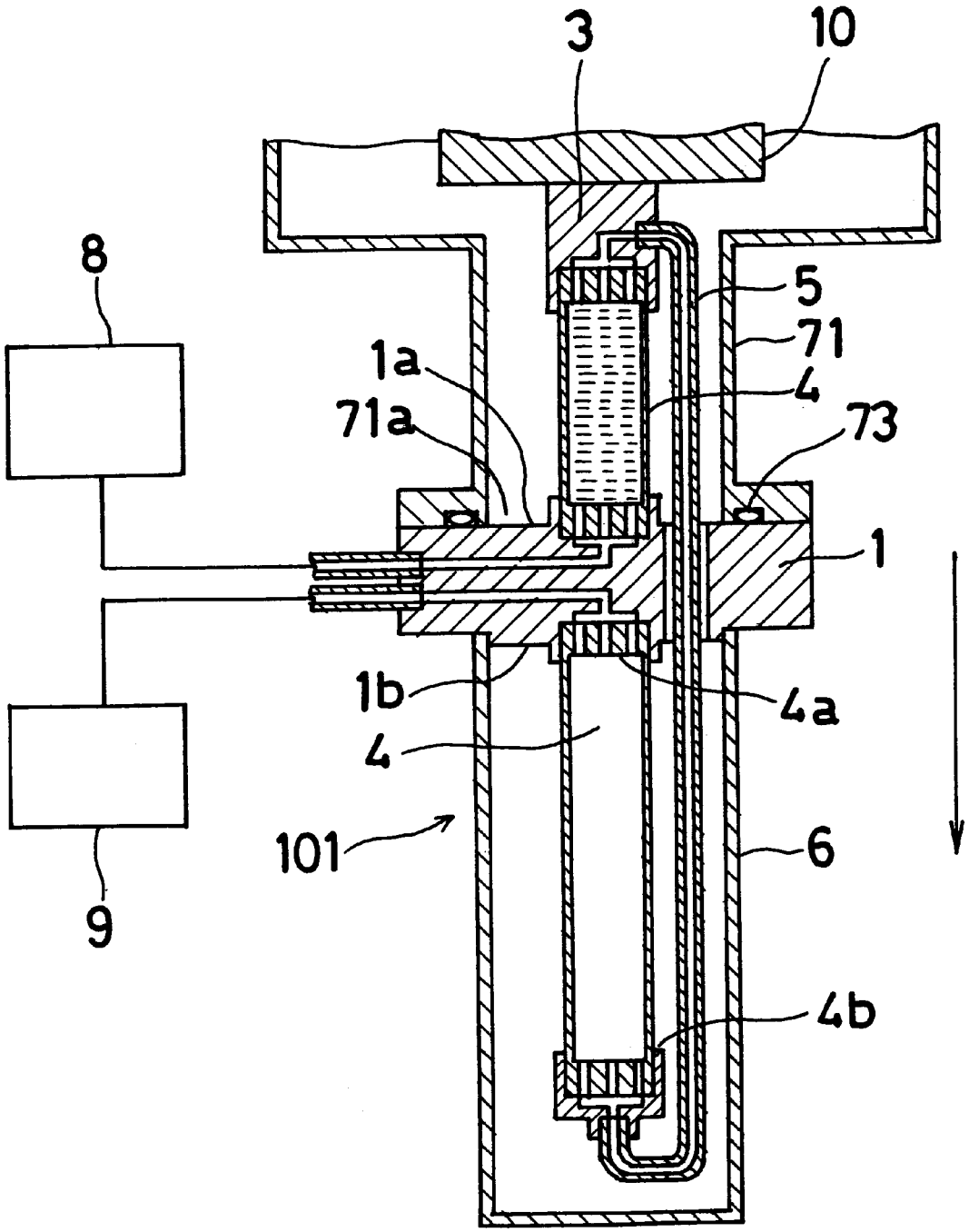
FIG. 2 is a view showing how the pulse tube refrigerator shown in FIG. 1 is brought into thermal connection to a member in a device from the bottom.

Referring next to FIG. 2, this Figure shows how the pulse tube refrigerator 101 cools the member 10 of a device below a determined temperature, which device is accommodated in a vacuum pan or vessel 71 in a heat insulated condition. The vacuum vessel 71 is formed at its lower end with an installing hole 71*a*. After the lower end of the vacuum vessel 71 is mounted on the upper side 1*a* of the supporting member 1 such that seal packing 73 is disposed for fluid-tight relationship therebetween, passing a connecting device such as a bolt (not shown) through the hole 71*a* establishes a rigid connection between the vacuum vessel 71 and the pulse tube refrigerator 101. After such a connection is established, evacuating the vessel 71 brings about a heat insulating condition of each of the regenerator 2, the pipe 5, the cold head 3, the pulse tube 4, and related elements and the member 10 which is in contact with the cold head 3 within the vacuum vessel 71 is brought into a cooled condition at the ultra low temperature.

In addition, as can be understood easily from the depiction of FIG. 2, the first lower end 4*b* of the pulse tube 4 is placed at a lower position than the higher temperature end 4*a* of the pulse tube 4, and so does not generate free convection of the working gas, which would lower the refrigerating efficiency. The reason is that the higher temperature end 4*a* is higher in temperature than the first lower temperature end 4*b*.

Figure 3:
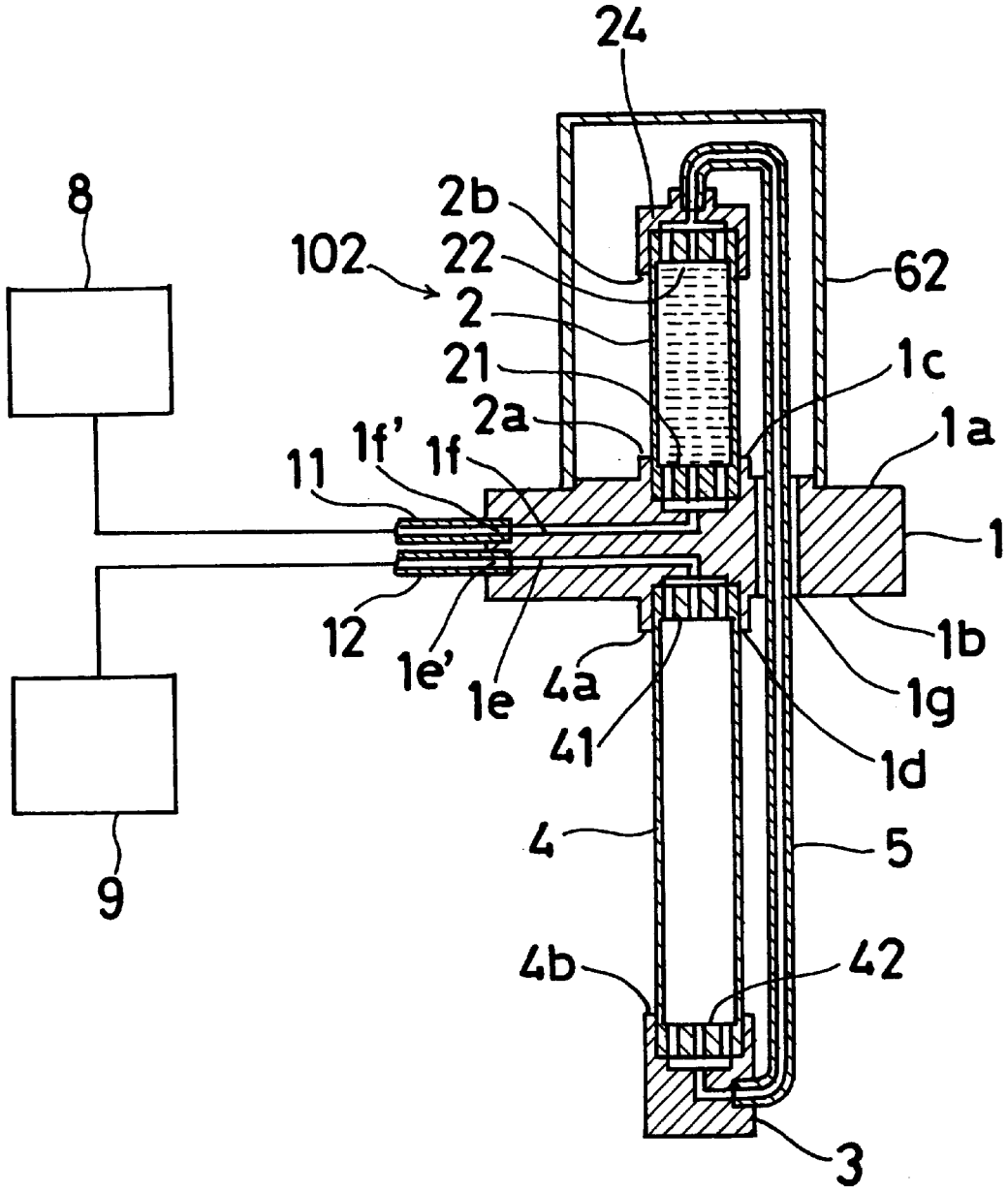
FIG. 3 is a partial vertical cross-sectional view of a pulse tube refrigerator as an alternative to the pulse tube refrigerator shown in FIG. 1.

Referring to FIG. 3, this figure shows a pulse tube refrigerator 102 as a first modification of the pulse tube refrigerator 101 shown in FIG. 1. The pulse tube refrigerator 102 is similar to the refrigerator 101 in structure and operation and therefore the same reference numbers are used to designate the same elements as in the first embodiment, which means that no description is made regarding the same elements and different parts only are explained hereinafter. In FIG. 3, a cold head 3 is fixedly mounted on a first lower temperature end 4*b* of a pulse tube 4 so that the cold head 3 is placed at the lowermost position of a pulse tube refrigerator 102. A vacuum heat insulated vessel 62 is mounted on an upper side 1*a* of a supporting member 1 so as to enclose a regenerator 2, a passing-through hole 1*g* formed in the supporting member 1, and a connecting pipe 5. The interior of the vessel 62 is brought into an evacuated condition for preventing entrance of heat from outside after the pulse tube refrigerator 102 is associated with a device or member 10 (FIG. 4) for cooling the same. The operation of the pulse tube refrigerator 102 is omitted due to the fact it is identical with the operation of the pulse-tube refrigerator 101 shown in FIG. 1.

Figure 4:
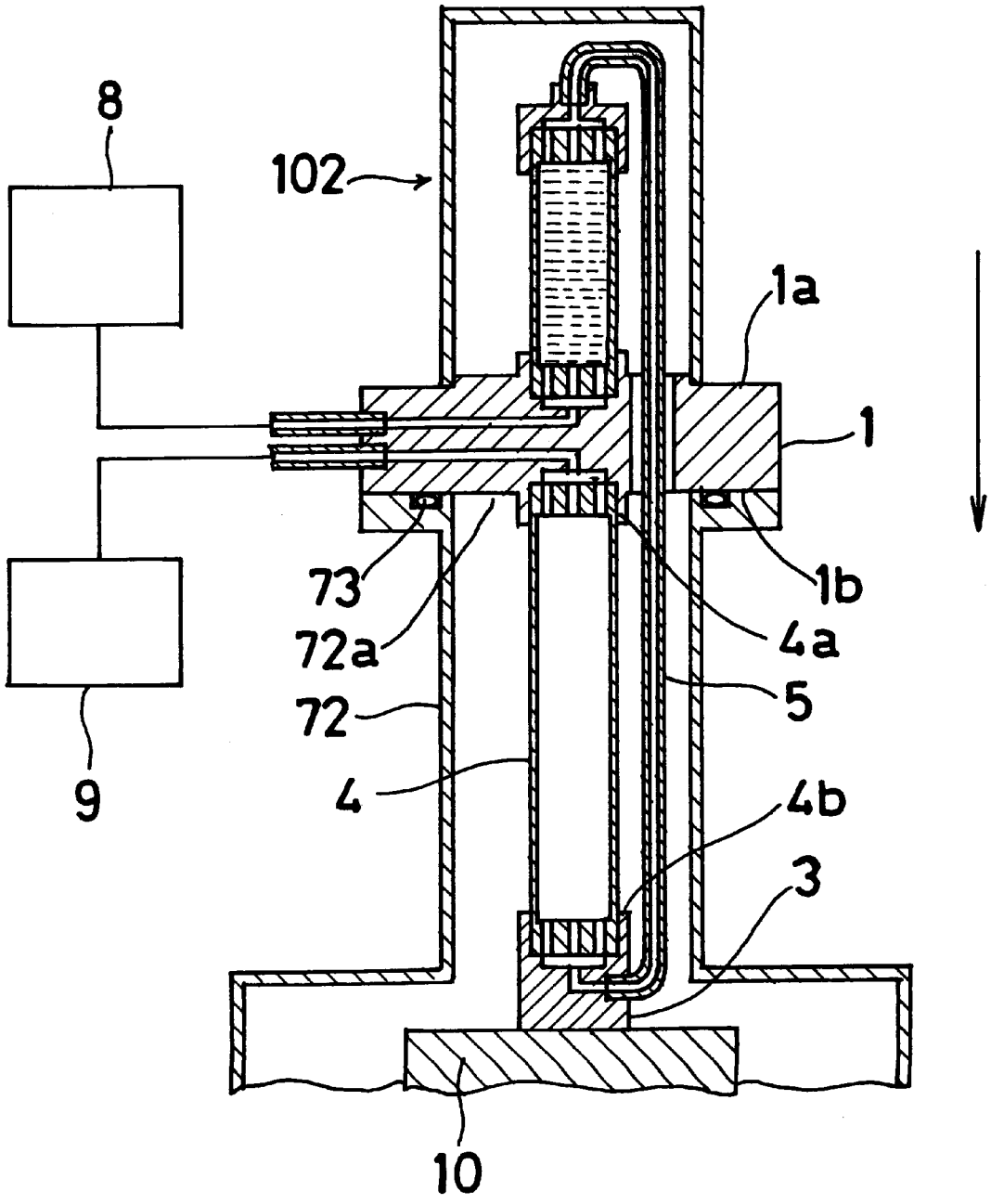
FIG. 4 is a view showing how the pulse tube refrigerator shown in FIG. 3 is brought into thermal connection to a member in a device from the top.

Referring next to FIG. 4, this Figure shows how the pulse tube refrigerator 102 cools the member 10 of a device below a determined temperature, which device is accommodated in a vacuum pan or vessel 72 in a heat insulated condition. The vacuum vessel 72 is formed at its lower end with an installing hole 72*a*. After the lower end of the vacuum vessel 72 is mounted on the upper side 1*a* of the supporting member 1 with seal packing 73 disposed for fluid-tight relationship therebetween, passing a connecting device such as a bolt (not shown) through the hole 72*a* establishes a rigid connection between the vacuum vessel 72 and the pulse tube refrigerator 102. After such a connection is established, evacuating the vessel 72 brings about a heat insulating condition of each of the regenerator 2, the pipe 5, the cold head 31, the pulse tube 4, and related elements, and the member 10 which is in contact with the cold head 3 within the vacuum vessel 72 is brought into a cooled condition at the ultra low temperature.

As can be understood easily from the depiction of FIG. 4, the first lower temperature end 4*b* of the pulse tube 4 is placed at a lower position than the first higher temperature end 4*a*. In light of the fact that the first higher temperature end 4*a* is higher in temperature than the lower temperature end 4*b*, such an arrangement means that no free convection of the working gas in the pulse tube 4 is generated, which would cause a lowering of the refrigerating efficiency.

As can be apparent from the foregoing two examples, each of the pulse tube refrigerators 101 and 102 is comprised of a supporting member 1 having an upper side 1*a* and a lower side 1*b*; a pulse tube 4 having at opposite ends thereof a first higher temperature end 4*a* connected to the lower side 1*b* of the supporting member 1 and a first lower temperature end 4*b*; a regenerator 2 having at opposite ends thereof a second higher temperature end 2*a* connected to the upper side 1*a* of the supporting member 1 and a second lower temperature end 2*b*; a connecting pipe 5 connected between the first lower temperature end 4*b* of the pulse tube 4 and the second temperature end 2*b* of the regenerator 2; a pressure oscillation device 8 oscillating a working gas filled in a system between the pulse tube 4 and the regenerator 2; and a phase difference controller 9 controlling a phase difference of a pressure oscillator and a displacement of the working gas.

Such a structure provides that holding the higher temperature end 4*a* of the pulse tube 4 on the lower side 1*b* of the supporting member 1 offers a downward extension of the pulse tube 4 which starts from the first higher temperature end 4*a* and terminating in the first lower end 4*b*, thereby establishing a lower placement of the first lower end 4*b* than the higher temperature end 4*a*. Thus an extension of the pulse tube 4 wherein the first higher temperature end 4*a* is above the first lower temperature end 4*b* of lower temperature does not cause free convection of the working gas in the pulse tube 4. Thus, the lowering of the refrigerating efficiency found in the conventional pulse tube refrigerator does not occur in each of the foregoing pulse tube refrigerators.

When an installation of the pulse tube refrigerator is required from the bottom of a member in a device which is to be cooled down, as shown in FIGS. 1 and 2, such a need is satisfied by mounting the cold head 3 on the second lower temperature end 2*b* of the regenerator 2. Such a provision of the cold head 3 means that the cold head 3 takes the uppermost position in the pulse tube refrigerator 101, thereby enabling an installation of the pulse tube refrigerator 101 to the device from the bottom such that the cold head 3 is in thermal contact with the member 10 for cooling the same below the determined temperature. In the resultant condition, the higher location of the higher temperature end 4*a* of the pulse tube 4 than the lower temperature end 4*b* thereof prevents generation of free convection of the working gas in the pulse tube 4. On the other hand, when the pulse tube refrigerator is required to be mounted on the device from the top, as shown in FIGS. 3 and 4, such a need is satisfied by mounting the cold head 3 on the first lower temperature end 4*b* of the pulse tube 4. Such a provision of the cold head 3 means that the cold head 3 takes the lowermost position in the pulse tube refrigerator 102, thereby enabling an installation of the pulse tube refrigerator 102 to the device from the top such that the cold head 3 is in thermal contact with the member 10 for cooling the same below the determined temperature. In the resultant condition, the higher location of the higher temperature end 4*a* of the pulse tube 4 than the lower temperature end 4*b* thereof prevents generation of free convection of the working gas in the pulse tube 4.

In accordance with a concept derived from the two examples as mentioned above, mounting the pulse tube refrigerator can be done from any one of the top and the bottom, and no difference in refrigerating efficiency results therefrom.

In addition, in each example, the connecting pipe 5 passes through the passing-through hole 1*g* formed in the supporting member 1 for connecting the first lower temperature end 4*b* of the pulse tube 4 and the second lower temperature end 2*b* of the regenerator 2. Such a connection establishes the shortest possible extension of the pulse tube 4 by passing through the supporting member 1. Due to the fact that the volume of the interior of the connecting pipe 5 is a dead space which does not contribute to the refrigerating efficiency, making the connecting pipe 5 as short as possible leads to a decrease of the volume of such a dead space of the connecting pipe 5, thereby increasing the refrigerating efficiency.

Second Embodiment

Figure 5:
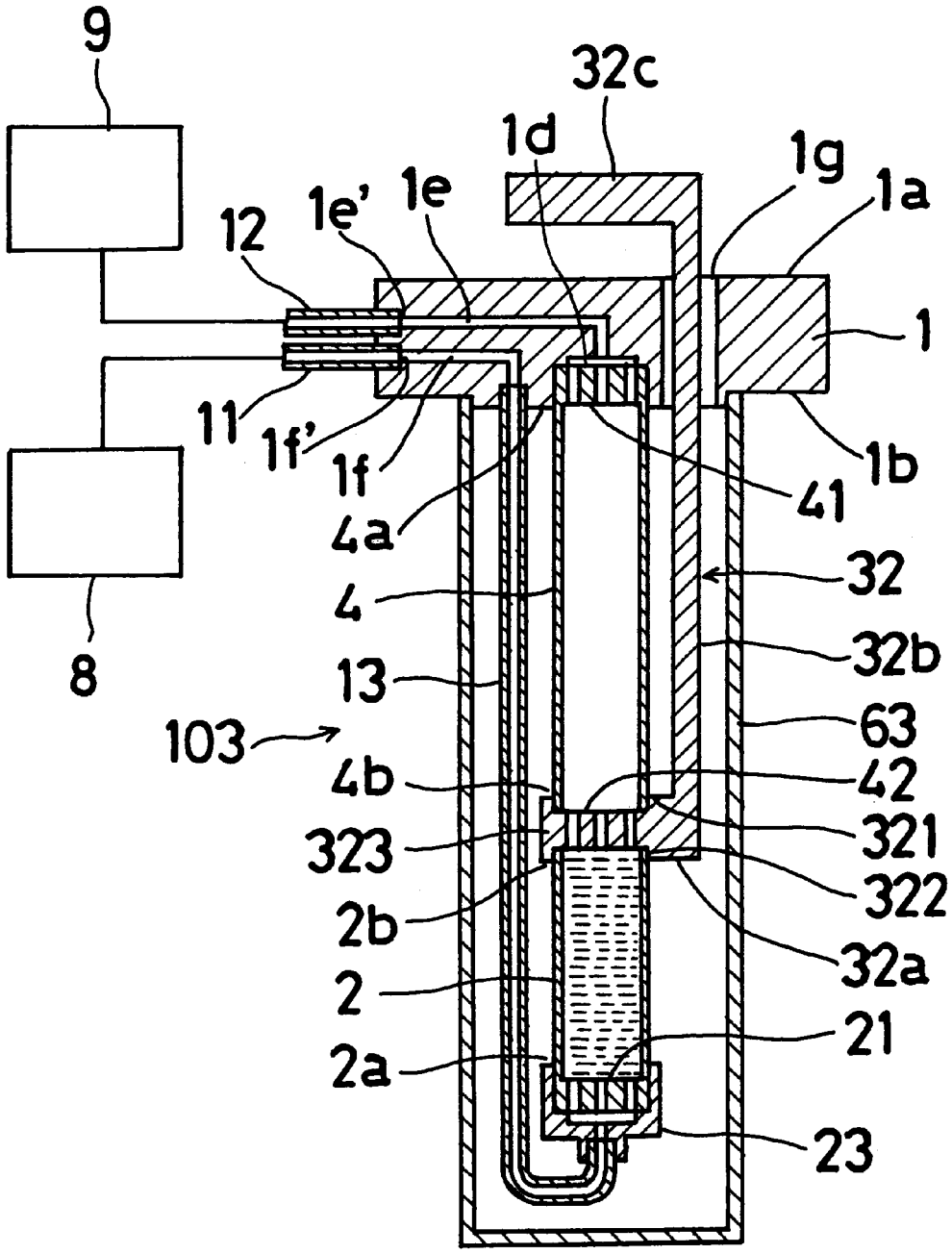
FIG. 5 is a partial vertical cross-sectional view of a second embodiment of a pulse tube refrigerator in accordance with the present invention.

Referring to FIG. 5, a pulse tube refrigerator 103 includes, as its major elements, a supporting member 1, a pulse tube 4, a regenerator 2, a pressure oscillation device 8, a phase difference controller 9, and a cold head 32. It is to be noted that same reference numbers are assigned to the same elements as in the first embodiment.

The supporting member 1 is in the form of an annular member formed of a metal such as copper, brass, a stainless steel or other similar material and has an upper end 1*a* and a lower end 1*b*. At the lower side 1*b* of the supporting member 1, there is formed a concave potion 1*d* for mounting the pulse tube 4. In the supporting member 1, there is formed a pulse tube passage 1*e* and a regenerator passage 1*f*. One end and the other end of the passage 1*e* respectively terminate in a bottom of the concave portion 1*d* in an open manner and in a left side of the supporting member 1 in an open manner. One end and the other end of the passage 1*f* respectively terminate in the lower side 1*b* of the supporting member 1 to be connected to a pipe 13 and in the left side of the supporting member 1. The supporting member 1 is provided therein with a vertical passing-through hole 1*g*.

The pulse tube 8 is so configured as to constitute a hollow cylindrical body having at opposite ends thereof a first end temperature end 4*a* and a first lower temperature end 4*b* at which flow adjusters 41 and 42 are provided, respectively. The pulse tube 4 is held by the supporting member 1 such that the first higher temperature end 4*a* of the pulse tube 4 is fitted in the concave portion 1*d* so as to establish a downward extension of the pulse tube 4.

The regenerator 2 is formed into a hollow cylindrical body having at its opposite ends a second higher temperature end 2*a* and a second lower temperature end 2*b*. Within the cylindrical body, there is provide a heat-retaining member which is in the form of a plurality of stacked meshed metal sheets of stainless steel. The regenerator 2 is provided at its higher temperature ends 2*a* with a flow adjuster 21. The lower temperature end 2*b* of the regenerator 2 having such a structure is in fluid communication with the lower temperature end 4*b* of the pulse tube 4.

A cold head 32 is held or provided between the first lower temperature end 4*b* of the pulse tube 4, and the lower temperature end 2*b* of the regenerator 2. The cold head 32 is divided into a first cold head portion 32*a*, a heat transfer portion 32*b*, and a second cold head portion 32*c*. The first cold head portion 32*a* is held or interposed between the first lower temperature end 4*b* of the pulse tube 4 and the lower temperature end 2*b* of the regenerator 2 for receiving coldness or an ultra low temperature generated at the lower temperature end 4*b* of the pulse tube 4. The heat transfer portion 32*b* is extended in the upward direction from the first cold head portion 32*a* and terminated in the second cold head portion 32*c* outside the supporting member 1 after being passed through the hole 1*g* formed in the supporting member 1. The second cold head portion 32*b* is used to cool a member 10 (FIG. 6) to be cooled below a determined temperature by being in thermal contact therewith. The cold head 32 having such a structure is in an integral configuration and is formed of a good thermal conductive metal such as copper for effective heat transfer. It is to be noted that the first cold head portion 32*a*, the heat transfer portion 32*b*, and the second cold head portion 32*c* can be formed into separate members.

The first cold head portion 32*a* is provided at its upper and lower sides with concave portions 321 and 322. The concave portions 321 and 322 are in receipt of the lower temperature end 4*a* of the pulse tube 4 and the lower end temperature end 2*b* of the regenerator 2, respectively. A passage 323 is formed in the first cold head portion 32*a* so as to establish a fluid communication between the lower temperature end 4*a* of the pulse tube 4 and the lower end temperature end 2*b* of the regenerator 2 via the concave portions 321 and 322.

The heat transfer portion 32*b* of the cold head 32 passes through the hole 1*g* in the supporting member 1 without thermal contact therebetween for effective heat transfer.

The passage 1*f* which is formed in the supporting member 1 as mentioned above is connected at its one end to the pipe 13, while the other end is terminated in an opening 1*f'* toward the outside of the member 1. The opening 1*f'* is connected with one end of a pipe 11, whose other end is connected to the pressure oscillation device 8. This pressure oscillation device 8 is identical with one provided in the first embodiment of the pulse tube refrigerator 101 in construction and operation and therefore further explanation of the pressure oscillation device 8 is omitted.

One end of the passage 1*e* formed in the supporting member 1 is, as previously mentioned, in fluid communication with the bottom of the concave portion 1*d*, while the other end of the passage 1*e* is terminated in an opening 1*e'* outside the left side of the member 1. The opening 1*f'* is in fluid communication with one end of a pipe 12 whose the other end is in fluid communication with the phase difference controller 9. This phase difference controller 9 is identical with one provided in the first embodiment of the pulse tube refrigerator 101 in construction and operation and therefore no further explanation of the phase difference controller 9 is made.

One end of the pipe 13 is connected at the lower side 1*b* of the supporting member 1 to the passage 1*e*, while the other end is in fluid communication with the second higher temperature 2*a* of the regenerator 2. Thus, the second higher temperature end 2*a* of the regenerator 2 is brought into fluid communication with the pressure oscillation device 8 via the pipe 13, the passage 1*f*, and the pipe 11.

A vacuum heat insulated case 63 is secured to the lower side 1*b* of the supporting member 1 so as to enclose therein the pulse tube 4, the regenerator 2, the hole 1*g* formed in the supporting member 1, the pipe 13, and the cold head 32. An interior of the case 63 is evacuated for heat insulating after the pulse tube refrigerator 103 is associated with the device including the member 10 to be cooled.

In operation, when the pressure oscillation device 8 is turned on, a pressure oscillation occurs in the working gas of a pulse refrigerating system constituted by the pipe 11, the pipe 13, the regenerator 2, the pulse tube 4, and the pipe 12. A phase difference is established between the pressure oscillation and the displacement of the working gas and the resultant phase difference is controlled by the phase difference controller 9. Optimizing the phase difference causes an adiabatic expansion of the working gas in the vicinity of the first lower temperature end 4*b*, which results in a generation of coldness or an ultra low temperature.

Figure 6:
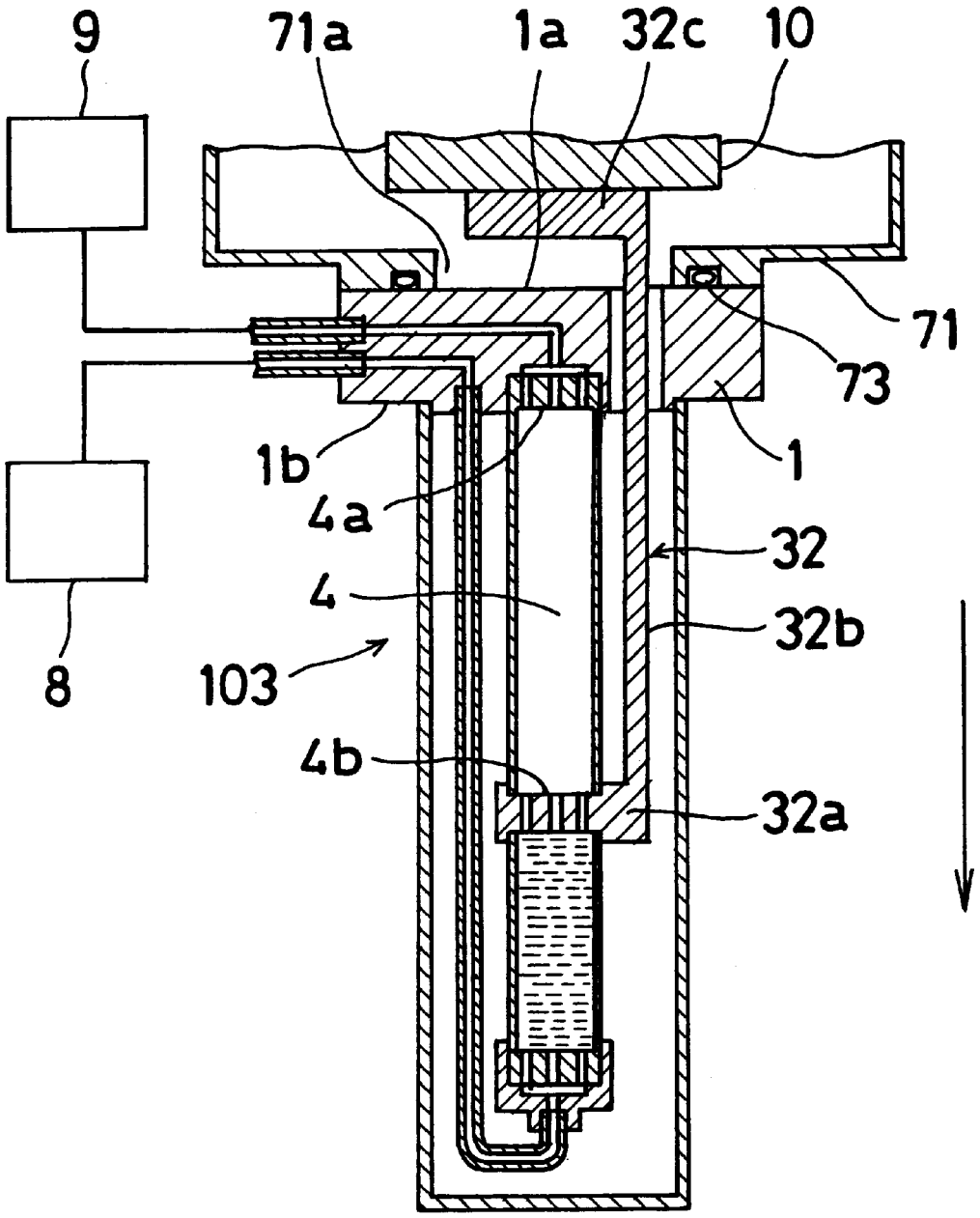
FIG. 6 is a view showing how the pulse tube refrigerator shown in FIG. 5 is brought into thermal connection to a member in a device from the bottom.

Referring next to FIG. 6, this Figure shows how the pulse tube refrigerator 103 cools the member 10 of a device below a determined temperature, which device is accommodated in a vacuum pan or vessel 71 in a heat insulated condition. The vacuum vessel 71 is formed at its lower end with an installing hole 71*a*. After the lower end of the vacuum vessel 71 is mounted on the upper side 1*a* of the supporting member 1 with a seal packing 73 disposed for fluid-tight relationship therebetween, passing a connecting-device such as a bolt (not shown) through the hole 71*a* establishes a rigid connection between the vacuum vessel 71 and the pulse tube refrigerator 103. After such a connection is established, evacuating the vessel 71 brings about a heat insulating condition of the pulse tube refrigerator 103, and the member 10 which is in contact with the second cold head portion 32*c* of the cold head 32 above the member 1 is brought into a cooled condition at an ultra low temperature.

In addition, as can be understood easily from the depiction of FIG. 6, the first lower end 4*b* of the pulse tube 4 is placed at a lower position than the higher temperature end 4*a* of the pulse tube 4, and so free convection of the working gas which lowers the refrigerating efficiency is not generated. The reason is that the first higher end 4*a* is higher in temperature than the first lower end 4*b*.

Figure 7:
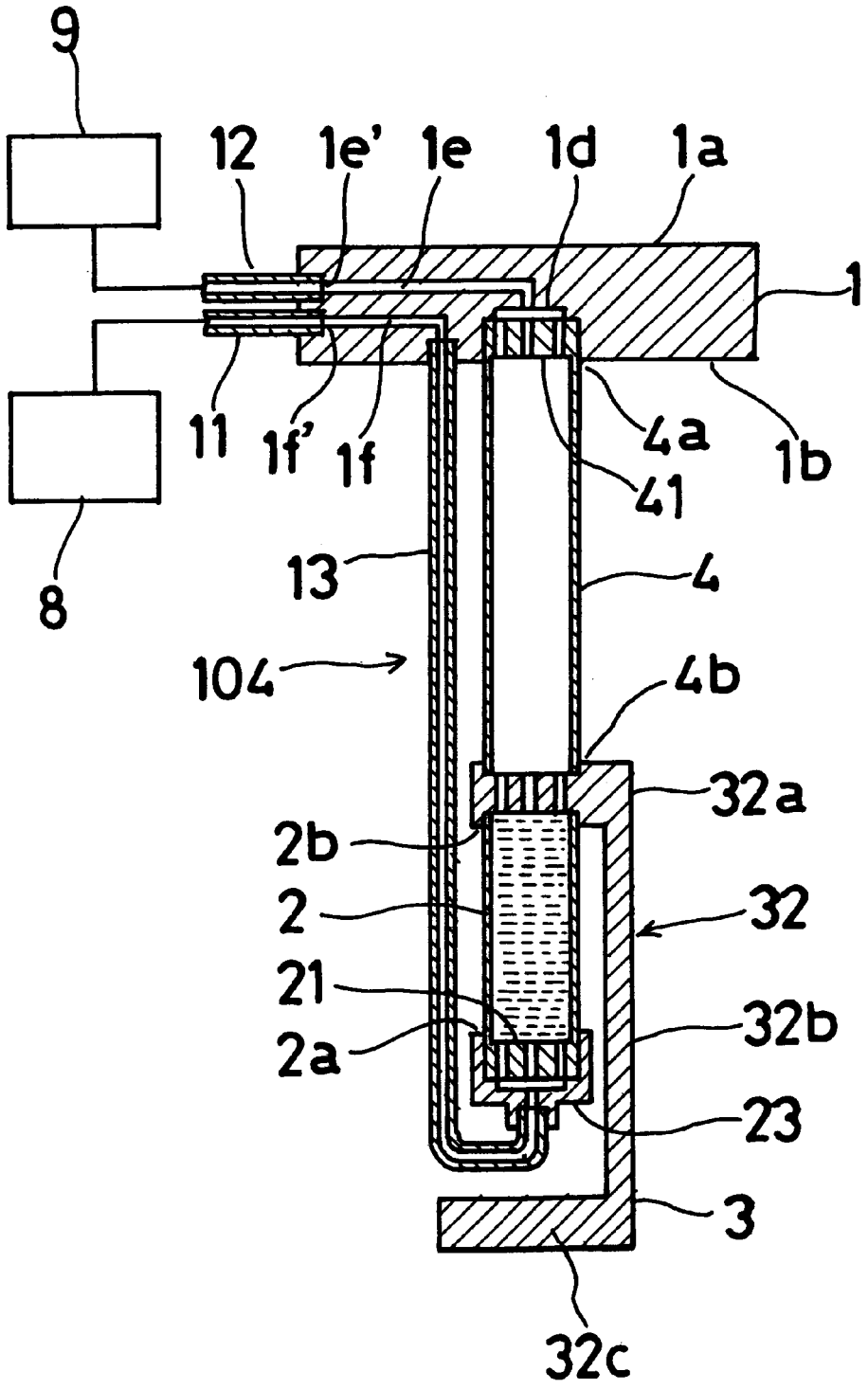
FIG. 7 is a partial vertical cross-sectional view of a pulse tube refrigerator as an alternative to the pulse tube refrigerator shown in FIG. 5.

Referring to FIG. 7 which shows a pulse tube refrigerator 104 as a modification of the pulse tube refrigerator 103 shown in FIG. 6. The pulse tube refrigerator 104 is similar to the refrigerator 103 in structure and operation and therefore the same reference numbers are assigned to the same elements as in the second embodiment, which means that no description is made regarding the same elements and different parts only are explained hereinafter. In FIG. 7, a cold head 32 is interposed between the first lower temperature end 4*b* of the pulse tube 4 and the second lower temperature end 2*b*. The cold head 32, which is formed in a one piece configuration, is divided into a first cold head portion 32*a*, a heat transfer portion 32*b*, and a second cold head portion 32*c*. The first cold head portion 32*a* is held between the first lower temperature end 4*b* of the pulse tube 4 and the second lower temperature end 2*b* so as to receive coldness or an ultra low temperature generated at the lower temperature end 4*b* of the pulse tube 4. The heat transfer portion 32*b* is extended in the downward direction from the first cold head portion 32*a* and terminated in the second cold head portion 32*c* below the second lower temperature 2*b* of the regenerator 2. The second cold head portion 32*c* of the cold head 32 is used to cool a member 10 (FIG. 8) below a determined temperature by contact therewith. Unlike in the pulse tube refrigerator 103, the supporting member 1 is not formed therein with a passing-through hole similar to the hole 1*g* shown in FIG. 5 and a member equivalent to the vacuum heat insulated case 71 is not provided. Other portions of the pulse tube refrigerator 104 are identical with the pulse tube refrigerator 103 shown in FIG. 5.

An operation of the pulse tube refrigerator 104 is omitted due to the fact it is identical with the operation of the pulse tube refrigerator 103 shown in FIG. 5.

Figure 8:
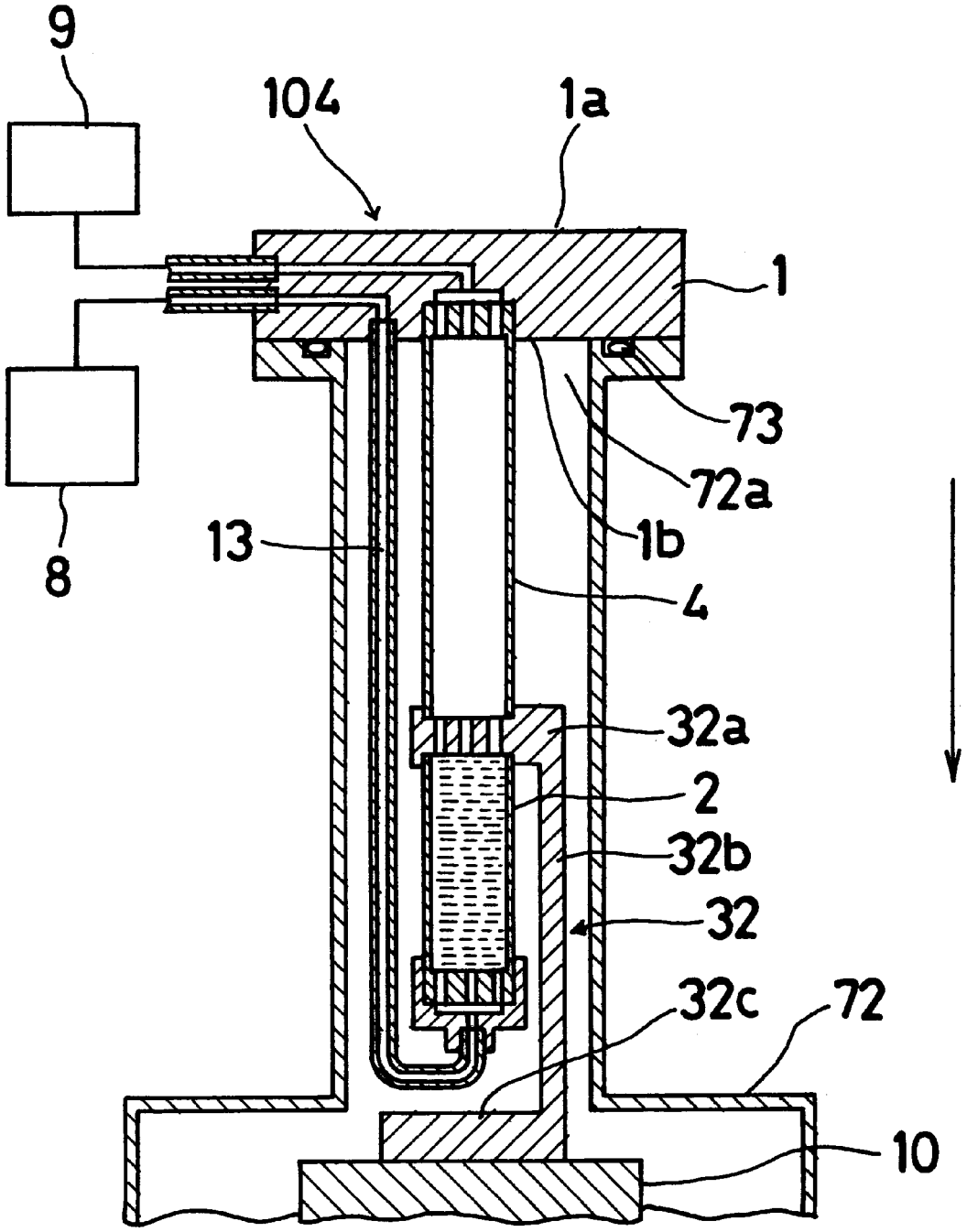
FIG. 8 is a is a view showing how the pulse tube refrigerator shown in FIG. 7 is brought into thermal connection to a member in a device from the top.

Referring next to FIG. 8, this Figure shows how the pulse tube refrigerator 104 cools the member 10 of a device below a determined temperature, which member is accommodated in a vacuum pan or vessel 72 in a heat insulated condition. The vacuum vessel 72 is formed at its upper end with an installing hole 72*a*. After the upper end of the vacuum vessel 72 is mounted on the lower side 1*b* of the supporting member 1 with seal packing 73 disposed therein for establishing a fluid-tight relationship therebetween, passing a connecting device such as a bolt (not shown) through the hole 72*a* establishes a rigid connection between the vacuum vessel 72 and the pulse tube refrigerator 104. After such a connection is established, evacuating the vessel 72 brings about a heat insulating condition of each of the regenerator 2, the pipe 5, the cold head 32, the pulse tube 4, and related elements and the member 10 which is in contact with the second cold head portion 32*c* of the cold head 32 within the vacuum vessel 72 is brought into a cooled condition at an ultra low temperature.

As can be understood easily from the depiction of FIG. 8, the first lower temperature end 4*b* of the pulse tube 4 is placed at a lower position than the first higher temperature end 4*a*. In light of the fact that the first higher temperature end 4*a* is higher in temperature than the lower temperature end 4*b*, such an arrangement means that no free convection of the working gas in the pulse tube 4 is generated, which would cause a lowering of the refrigerating efficiency.

As is apparent from the foregoing two examples, each of the pulse tube refrigerators 103 and 104 is comprised of a supporting member 1 having an upper side 1*a* and a lower side 1*b*; a pulse tube 4 having at opposite ends thereof a first higher temperature end 4*a* held at the lower side 1*b* of the supporting member 1 and a first lower temperature end 4*b*; a regenerator 2 having at opposite ends thereof a second higher temperature end 2*a* and a second lower temperature end 2*b* which is in fluid communication with the lower temperature end 4*b* of the pulse tube 4; a pressure oscillation device 8 connected to the second higher temperature end 2*a* of the regenerator 2 for oscillating a working gas filled in a system defined between the regenerator 2 and the pulse tube 4; a phase difference controller 9 controlling a phase difference of a pressure oscillation and a displacement of the working gas; and a cold head 32 having a first cold head portion 32*a* held between the first lower temperature end 4*b* of the pulse tube 4 and the second lower temperature end 2*b* of the regenerator 2 and a second cold head portion 32*c* thermally coupled to the first cold head portion 32*a* and in thermal contact with a member 10 to be cooled.

Such a structure provides that holding the higher temperature end 4*a* of the pulse tube 4 on the lower side 1*b* of the supporting member 1 offers a downward extension of the pulse tube 4 which starts from the first higher temperature end 4*a* and terminating in the first lower end 4*b*, thereby establishing a lower placement of the first lower temperature end 4*b* than the higher temperature end 4*a*. Thus such an extension of the pulse tube 4 wherein the first higher temperature end 4*a* is above the first lower temperature end 4*b* prevents free convection of the working gas in the pulse tube 4. Thus, the lowering of the refrigerating efficiency found in the conventional pulse tube refrigerator does not occur in each of the foregoing pulse tube refrigerators.

When an installation of the pulse tube refrigerator is required from the bottom of a member in a device which is to be cooled down, as shown in FIGS. 5 and 6, such a need is satisfied by placing the second cold head portion 32*c* of the cold head 32 above the supporting member 1 which is in thermal connection with the first cold head portion 32*a* between the lower temperature end 2*b* and 4*b* so as to establish a thermal direct contact of the second cold head portion 32*c* with the member 10. Employing such an extension of the cold head 32 means that the cold head 32 takes the uppermost position in the pulse tube refrigerator 103, thereby enabling an installation of the pulse tube refrigerator 103 to the device from the bottom such that the second cold head portion 32*c* of the cold head 32 is in thermal contact with the member 10 for cooling the same below the determined temperature. In the resultant condition, the higher location of the higher temperature end 4*a* of the pulse tube 4 than the lower temperature end 4*b* thereof prevents a generation of free convection of the working gas in the pulse tube 4. On the other hand, when the pulse tube refrigerator is required to be mounted on the device from the top, as shown in FIGS. 7 and 8, such a need is accomplished by positioning the second cold head portion 32*c* below the second higher temperature end 2*a* of the regenerator 2 so as to be thermally engaged with the member 10. Such a positioning of the cold head 32 means that the cold head 32 takes the lowermost position in the pulse tube refrigerator 104, thereby enabling an installation of the pulse tube refrigerator 104 to the device from the top such that the second cold head portion 32*c* of the cold head 32 is in thermal contact with the member 10 for cooling the same below the determined temperature. In the resultant condition, the higher location of the higher temperature end 4*a* of the pulse tube 4 than the lower temperature end 4*b* thereof prevents a generation of free convection of the working gas in the pulse tube 4.

In accordance with a concept derived from the two examples as mentioned above, mounting the pulse tube refrigerator can be associated with the device from any one of the top and the bottom such that no difference in refrigerating efficiency results.

Third Embodiment

Figure 9:
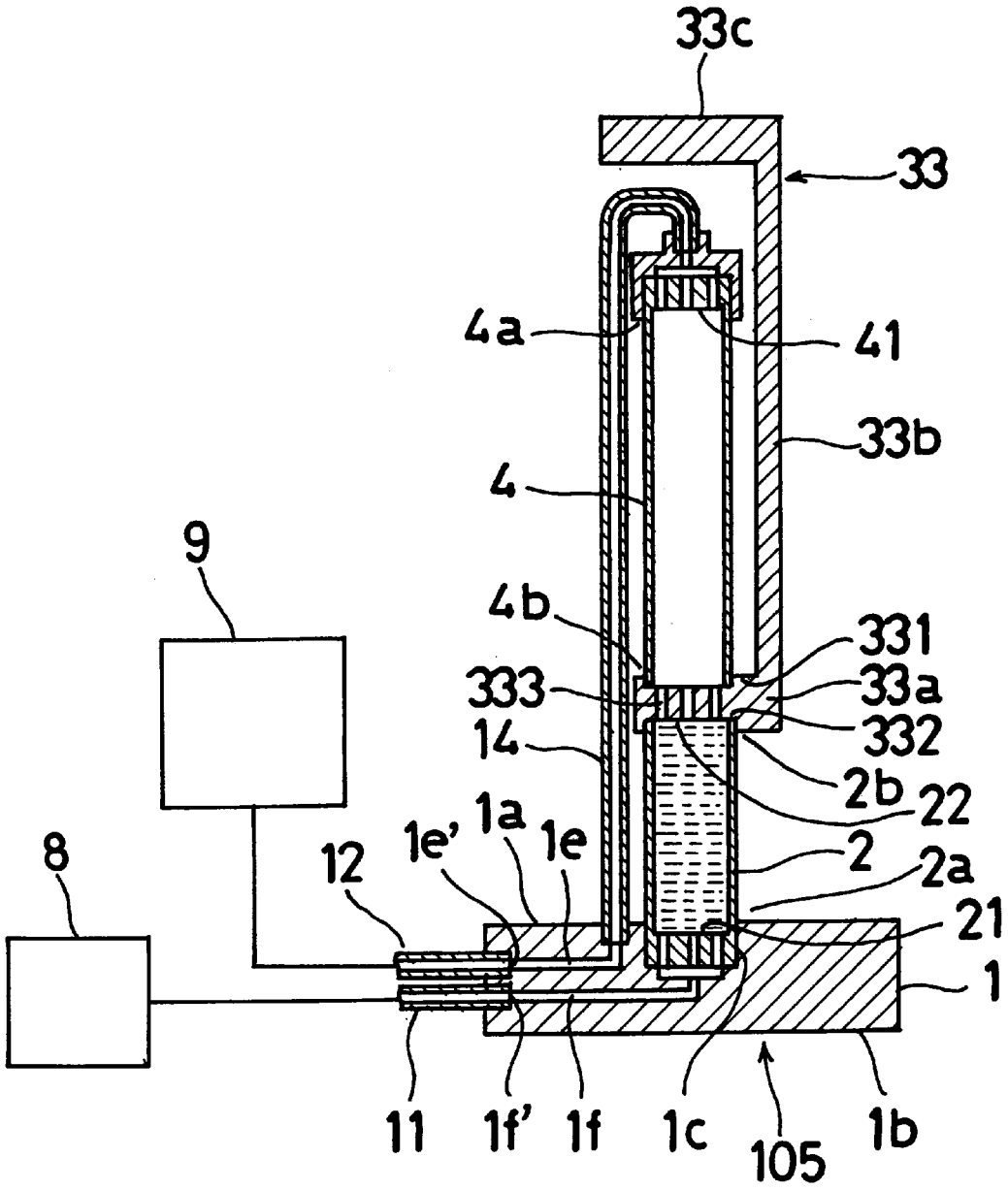
FIG. 9 is a partial vertical cross-sectional view of a third embodiment of a pulse tube refrigerator in accordance with the present invention.

Referring to FIG. 9, a pulse tube refrigerator 105 includes, as its major elements, a supporting member 1, a pulse tube 4, a regenerator 2, a pressure oscillation device 8, a phase difference controller 9, and a cold head 33.

The supporting member 1 is in the form of an annular member formed of a metal such as copper, brass, a stainless steel or other similar material and has an upper end 1*a* and a lower end 1*b*. At the upper end 1*a* of the supporting member 1, there is formed a concave potion 1*c* for a mounting of the regenerator 2. In the supporting member 1, there is formed a pulse tube passage 1*e* and a regenerator passage 1*f*. One end and the other end of the passage 1*e* respectively terminate in the upper side 1*a* of the member 1 in an open manner to be in fluid communication with a pipe 14 and in an opening 1*e*' at a left side of the supporting member 1. One end and the other end of the passage 1*f* respectively terminate in a bottom of the concave portion 1*c* in an open manner and in an opening 1*f*' at the left side of the supporting member 1.

The pulse tube 4 is in the form of a hollow cylindrical body which has at opposite ends thereof a first higher temperature end 4*a* and a first lower temperature end 4*b*. At the first higher temperature end 4*a* of the pulse tube 4, there is provided a flow adjuster 41.

The regenerator 2 is so configured as to be a hollow cylindrical body having at opposite end thereof a second higher temperature end 2*a* and a second lower temperature end 2*b*. Within the cylindrical body, there is provided a heat-retaining member which is in the form of a plurality of stacked meshed metal sheets of stainless steel. The regenerator 2 is held at the supporting member 1 such that the second higher temperature end 2*a* is fitted in the concave portion 1*c* in the upper side 1*a* of the supporting member 1 and the second lower temperature end 2*b* is in fluid communication with the first lower temperature end 4*b* of the pulse tube 4.

Between the first lower temperature end 4*b* of the pulse tube 4 and the second temperature end 2*b* of the regenerator 2, there is interposed a cold head 33. The cold head 33 is formed into a one-piece configuration having a first cold head portion 33*a,* a heat transfer portion 33*b,* and a second cold head portion 33*c*. The first cold head portion 33*a* of the cold head 33 is expected to receive coldness or an ultra low temperature generated at the first lower temperature end 4*b* of the pulse tube 4 by being held between the lower temperature ends 2*b* and 4*b*. The heat transfer portion 33*b* extends in the upward direction toward a position above the higher temperature end 4*a* of the pulse tube 4 as depicted. The second cold head portion 33*c* is continuous with the upper end of the heat transfer portion 33*b* and is in contact with a member 10 (FIG. 10) for cooling the same below a determined temperature. The cold head 33 having this construction is formed of copper which is excellent in heat transfer for establishing excellent refrigerating efficiency. It is to be noted that the cold head 33 can be obtained by assembling separate first cold head portion 33*a,* heat transfer portion 33*b,* and second cold head portion 33*c* into the foregoing one-piece structure.

The first cold head portion 33*a* of the cold head 33 is provided at its upper and lower sides with a concave portion 331 for receiving therein the pulse tube 4 and a concave portion 332 for receiving the regenerator 2, respectively. In addition, in the first cold head portion 33*a* of the cold head 33, there is formed a passage 333 for establishing fluid communication between the concave portions 331 and 332. The pulse tube 4 is held at its first lower temperature end 4*b* in the concave portion 331 and the regenerator 2 is held at its second lower temperature end 2*b* in the concave portion 332. The passage 333 formed in the first cold head portion 33*a* of the cold head 33 connects fluidly the first lower temperature end 4*b* of the pulse tube 4 and the second lower temperature end 2*b* of the regenerator 2.

One end of the passage 1*f* which is formed in the supporting member 1 is in fluid communication with the concave portion 1*c* and the other end of the passage 1*f* is terminated in the opening 1*f*' at the left side of the supporting member 1 as described above. The opening 1*f*' is connected with one end of a pipe 11 whose the other end is connected to the pressure oscillation device 8. The pressure oscillation device 8 is identical with that of the first embodiment of the pulse tube refrigerator in construction and operation and therefore further explanation of the pressure oscillation device 8 is omitted.

One end of the passage 1*e* which is formed in the supporting member 1 opens at the upper side 1*a* of the supporting member 1 for being in fluid communication with the pipe 14 and the other end of the passage 1*e* terminates in the opening 1*e*' at the left side of the supporting member 1, as previously explained. The opening 1*e*' is connected via a pipe 12 to the phase difference controller 9. It is to be noted that the phase difference controller 9 is identical with that in the first embodiment of the pulse tube refrigerator 101 in construction and operation and therefore further explanation related to the phase difference controller 9 is omitted.

One end and the other end of the pipe 14 is opened at the upper side 1*a* of the supporting member 1 and is in fluid communication with the first higher temperature end 4*a* of the pulse tube 4. Thus, the first higher temperature end 4*a* of the pulse tube 4 is brought into fluid communication with the phase difference controller 9 via the pipe 14, the passage 1*e* and the pipe 12.

When the pressure oscillation device 8 is brought into operation, a working gas filled in the system is varied in pressure during continuous connection of the passage 11, the regenerator 2, the pulse tube 4, the pipe 14 and the pipe 12. This results in a phase difference between a pressure oscillation and a displacement in the working gas. Optimizing such a phase difference causes an adiabatic expansion of the working gas at-and-near the first lower end 4*b* of the pulse tube, resulting in generation of coldness or an ultra low temperature in this region.

Figure 10:
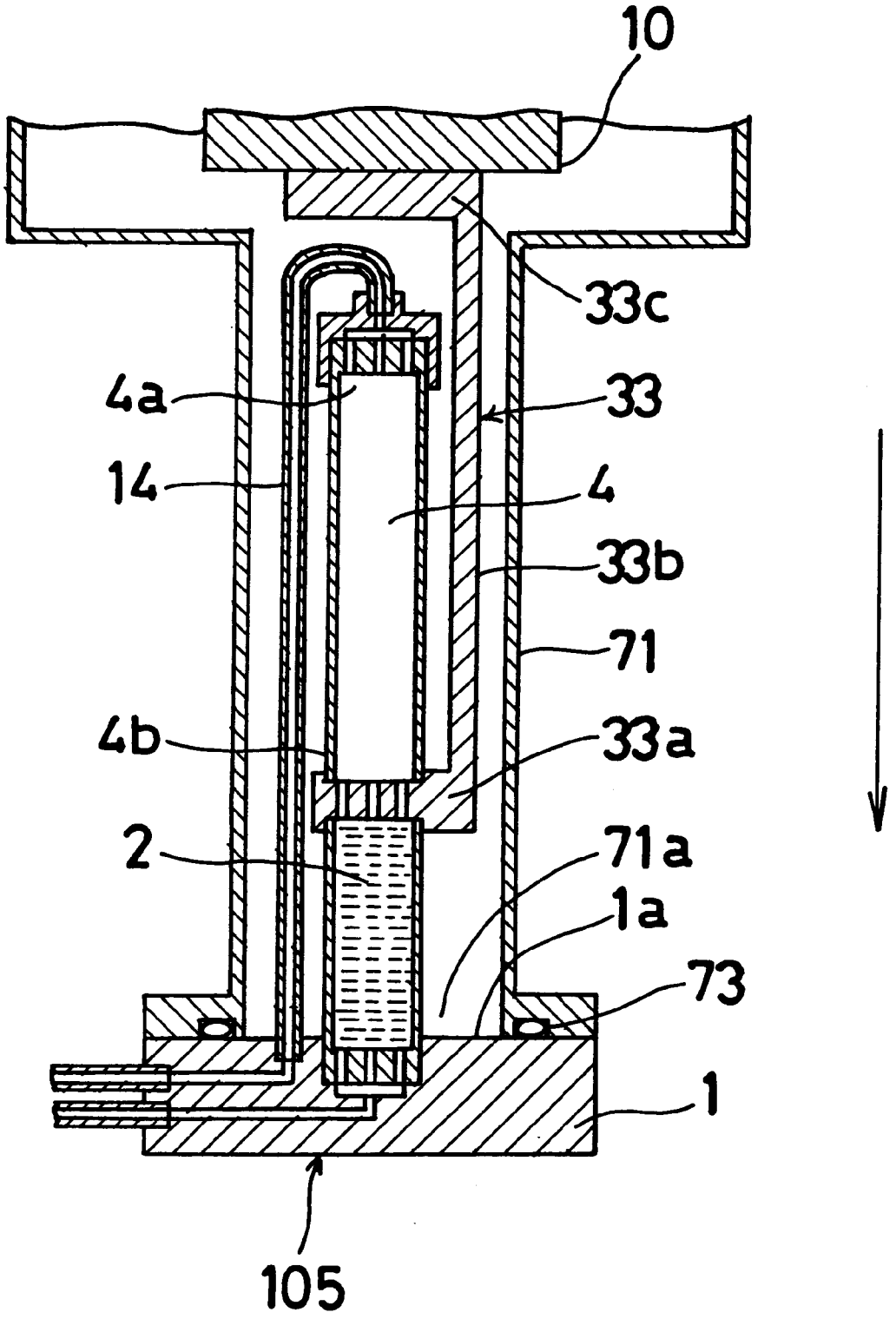
FIG. 10 is a view showing how the pulse tube refrigerator shown in FIG. 9 is brought into thermal connection to a member in a device from the bottom.

Referring next to FIG. 10, this Figure shows how thermal contact is established between the member 10 in a vacuum heat-insulated vessel 72 and the cold head 33 of the pulse tube refrigerator 105. As can be understood easily from FIG. 10, at a lower side of the vessel 71, there is provided a hole 71*a*. After mounting the lower side of the vessel 71 via a seal packing member 73 on the upper side 1*a* of the supporting member 1, a rigid connection between the vessel 71 and the member 1 is established. Evacuating such a vessel 71 brings about a heat-insulated or adiabatic condition of each of the regenerator 2, pulse tube 4, and the cold head 33 which are placed on or above the supporting member 1 and the member 10 in the vessel 71 which is in contact with the second cold head portion 33*c* of the cold head 33 is cooled down below a determined temperature by the coldness or the ultra low temperature generated at or near the first lower temperature end 4*b* of the pulse tube 4.

FIG. 10 indicates clearly that the first lower temperature end 4*b* of the pulse tube 4 is at a lowered position relative to its first higher temperature end 4*a*. Such an arrangement does not generate free convection of the working gas in the pulse tube 4, which is a cause of lowering the efficiency of the refrigeration.

It is to be noted that a modification (not illustrated) of the pulse tube refrigerator 104 can be established by extending the cold head 33 in the upward direction though a passage (corresponding to the hole 1*g* shown in FIG. 5) formed in the supporting member 1. Such a structure enables contact of the second cold head portion 33*c* of the cold head 33 to the member 10 from the bottom.

As can be apparent from the foregoing two modes, the third embodiment of the present invention offers a pulse tube refrigerator which includes a supporting member 1 having an upper side 1*a* and a lower side 1*b;* a pulse tube 4 having at opposite ends thereof a first higher temperature end 4*a* and a first lower temperature end 4*b;* a regenerator 2 having at opposite ends thereof a second higher temperature end 2*a* held on the upper side 1*a* of the supporting member 1 and a second lower temperature end 2*b* being in fluid communication with the first lower temperature end 4*b* of the pulse tube 4; a pressure oscillation device 8 connected to the second higher temperature end 2*a* of the regenerator for oscillating a working gas filled in a system defined between the regenerator 2 and the pulse tube 4; a phase difference controller 9 controlling a phase difference between a pressure oscillation and a displacement of the working gas; and a cold head 33 having a first cold head portion 33*a* held between the first lower temperature end 4*b* of the pulse tube 4 and the second lower temperature end 2*b* of the regenerator 2 and a second cold head portion 33*c* thermally coupled to the first cold head portion 33*a* and being in thermal contact with a member 10 to be cooled.

In such a structure, the second lower temperature end 2*b* of the regenerator 2 which is held at its second higher temperature end 2*a* in the upper side 1*a* of the supporting member 1 is connected to the first lower temperature end 4*b* of the pulse tube 4 from the bottom side thereof. This means that the pulse tube extends in the upward direction from the first lower temperature end 4*b* to the higher temperature end 4*a,* resulting in that the higher temperature end 4*a* takes a higher position than the first lower temperature end 4*b*. Thus, no free convection of the working gas occurs in the pulse tube 4, which is a cause of lowering the refrigerating efficiency.

To associate the pulse tube refrigerator having the foregoing structure with a device accommodating therein a member to be cooled from the bottom side of the device, the member 10 is brought into contact with the second cold head portion 33*c* extending via the heat transfer portion 33*b* from the first cold head portion 33*a* held between the first lower temperature end 4*b* of the pulse tube 4 and the lower temperature end 2*b* of the regenerator 2 after positioning the second cold head portion 33*c* of the cold head 33 above the first lower temperature end 4*a* of the pulse tube 4. Such an extension of the cold head 33 permits the second cold head portion 33*c* of the cold head 33 to take the uppermost position in the pulse tube refrigerator and therefore the foregoing contact of the second cold head portion 33*c* with the member 10 from the bottom. In such a structure, the higher position of the first higher temperature end 4*a* than the first lower temperature end 4*b* of the pulse tube 4 prevents occurrence of free convection of the working gas in the pulse tube 4. On the other hand, if installing the pulse refrigerator on the device from the top side thereof is intended, such an intention can be satisfied by connecting the second cold head portion 33*c* of the cold head 33 with the member 10 after the positioning of the second cold head portion 33*c* of the cold head 33 below the supporting member 1 by passing the heat transfer portion 33*b* of the cold head 33. Such a structure means that the second cold head portion 33*c* of the cold head 33 take the lowermost position in the pulse tube refrigerator, which enables an installment thereof on the device from the top for cooling the member 10 by the thermal contact between the second cold head portion 33*c* of the cold head 33 and the member 10 in the device. In such a structure, the higher position of the first higher temperature end 4*a* than the first lower temperature end 4*b* of the pulse tube 4 prevents occurrence of free convection of the working gas in the pulse tube 4.

The pulse tube refrigerator in accordance with the third embodiment of the present invention, mounting the pulse tube refrigerator on the device can be attained from any one of the top and the bottom with the refrigerating efficiency unchanged.

Fourth Embodiment

Figure 11:
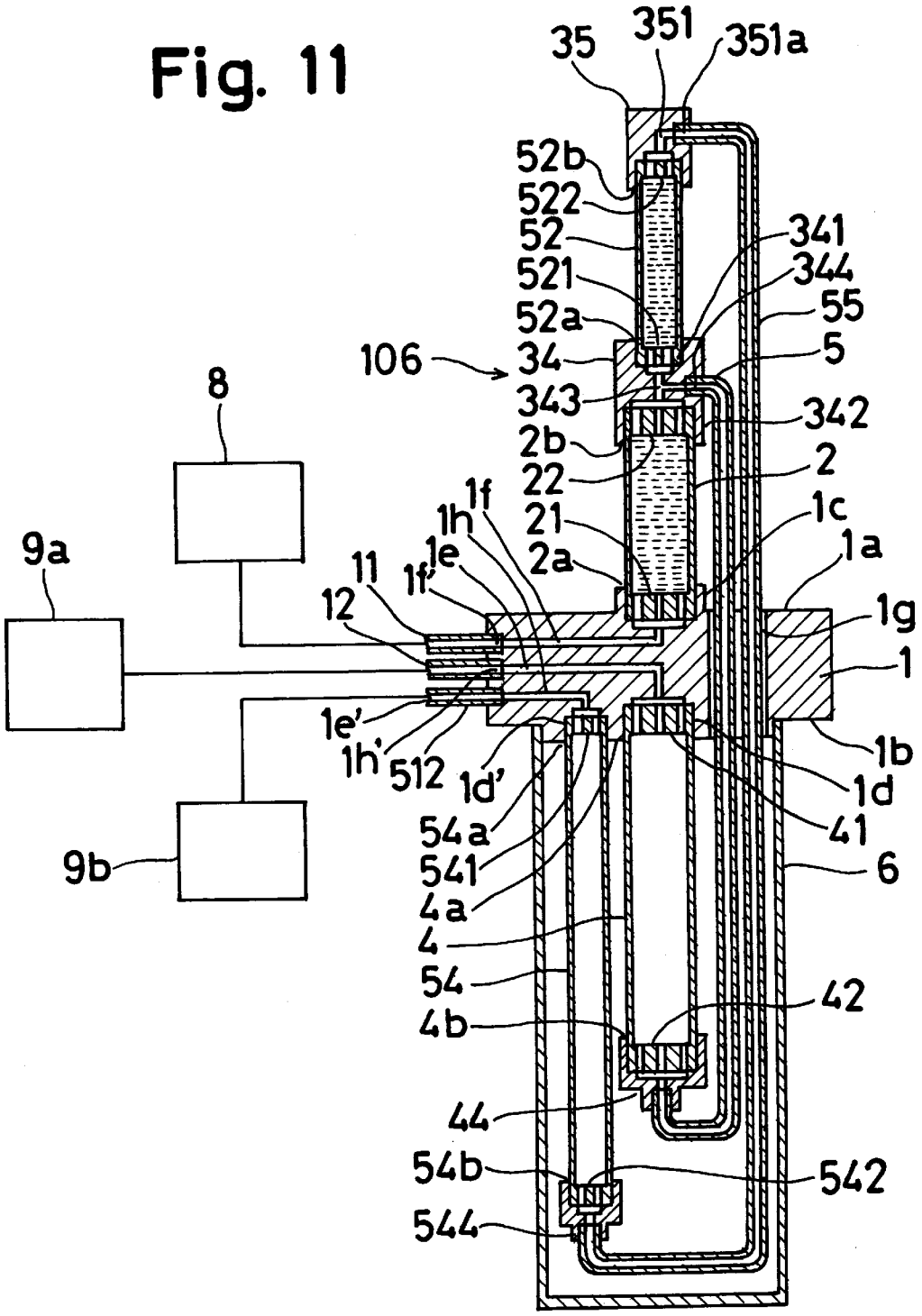
FIG. 11 is a partial vertical cross-sectional view of a fourth embodiment of a pulse tube refrigerator in accordance with the present invention.

Referring to FIG. 11 wherein a pulse tube refrigerator 106 in accordance with the present invention is illustrated. The pulse refrigerator 106 includes as its major elements a supporting member 1, a first pulse tube 4, a second pulse tube 54, a first regenerator 2, a second regenerator 52, a pressure oscillation device 8, a first phase difference controller 9*a,* a second phase difference controller 9*b,* a first pipe 5 and a second pipe 55. In the pulse tube refrigerator 106, the regenerators 2 and 52 are arranged in a two stage construction and therefore the pulse tube refrigerator 106 is called a two stage type refrigerator.

The supporting member 1 having an upper side 1*a* and a lower side 1*b* is in the form of an annular member which is formed of a metal such as copper, brass or a stainless steel. The upper side 1*a* of the supporting member 1 is provided with a concave portion 1*c,* while the lower side 1*b* of the supporting member 1 is provided with concave portions 1*d* and 1*d*'. The supporting member 1 is also formed therein with a first pulse tube passage 1*e,* a second pulse tube passage 1*h,* and a regenerator passage 1*f*. One end of the first pulse tube passage 1*e* is terminated in a bottom of the concave portion 1*d* in an open manner, while the other end of the passage 1*e* is terminated in an opening 1*e*' at a left side of the supporting member 1. One end of the second pulse tube passage 1*h* is terminated in a bottom of the concave portion 1*d* in an open manner, while the other end of the passage 1*h* is terminated in an opening 1*h*' at the left side of the supporting member 1. One end of the first pulse tube passage 1*f* is terminated in a bottom of the concave portion 1*c* in open manner, while the other end of the passage 1*f* is terminated in an opening 1*f*' at the left side of the supporting member 1. Furthermore, the supporting member 1 is formed therein with a passage 1*g* passing therethrough and extending in the vertical direction.

The first pulse tube 4 is formed of a hollow cylindrical body and has at its opposite ends a higher temperature end 4*a* and a mid-lower temperature end 4*b* which are provided with flow adjusters 41 and 42, respectively. The first pulse tube 4 is held by the supporting member 1 in such a manner that the first higher temperature end 4*a* is fitted in the concave portion 1*d* of the supporting member 1. Similarly, the second pulse tube 54 is in the form of a hollow cylindrical body having at opposite ends thereof a higher temperature end 54*a* and a mid-lower temperature end 54*b* which are provided with flow adjusters 541 and 542, respectively. The second pulse tube 54 is held by the supporting member 1 in such a manner that the higher temperature end 54*a* of the second pulse tube 54 is fitted in the concave portion 1*d*' of the supporting member 1.

The first regenerator 2 is a hollow cylindrical body having at its opposite ends a higher temperature end 2*a* and a mid-lower temperature end 2*b,* respectively. Within the cylindrical body, there are provided a plurality of stacked heat retaining metal sheets of meshed stainless steel. Similar to the first pulse tube 4, flow adjusters 21 and 22 are provided in the higher temperature end 2*a* and the lower temperature end 2*b* of the first regenerator 2, respectively. The first regenerator 2 is held by the supporting member 1 in such a manner that the higher temperature end 2*a* of the first regenerator 2*a* is in fitting engagement with the concave portion 1*c*. The second regenerator 52 is a hollow cylindrical body having at its opposite ends a mid-lower temperature end 52*a* and a lower temperature end 52*b,* respectively. Within the cylindrical body, there are provided a plurality of stacked heat retaining metal sheets of meshed stainless steel. The ends 52*a* and 52*b* of the second regenerator 52 are provided therein with flow adjusters 521 and 522, respectively, and the mid-lower temperature end 52*a* of the second regenerator 52 is in fluid communication with the lower temperature end 2*b* of the first regenerator 2.

Between the mid-lower temperature end 2*b* of the first regenerator 2 and the midlower temperature end 52*a* of the second regenerator 52, there is interposed a first cold head 34. The first cold head 34 is provided at its upper and lower ends with a concave portion 341 and 342, respectively. The first cold head 34 is also formed therein with a vertically extending passage 343 which establishes a continual fluid communication between the concave portions 341 and 342. The mid-lower temperature end 2*b* of the first regenerator 2 and the mid-lower temperature end 52*a* of the second regenerator 52 are fitted in the concave portions 342 and 341, respectively, and are brought into fluid communication to each other by way of the passage 343. A midway portion of the passage 433 is connected with one end of a passage 344 whose the other end is in fluid communication with one end of the first pipe 5. The first pipe 5 extends in the downward direction, passes through the hole 1*g* of the supporting member 1, and terminates in connection with the mid-lower temperature end 4*b* of the first pulse tube 4.

One end of the passage 1*f* formed in the supporting member 1 is in fluid communication with the concave portion 1*c,* while the other end is terminated in the opening 1*f*' at the left side of the supporting member 1, as previously mentioned. The other end 1*f*' of the passage 1*f* is connected to the pressure oscillation device 8 through a pipe 11. The pressure oscillation device 8 is identical with that mentioned above and therefore no further explanation thereof is made hereinafter.

One end passage 1*e* formed in the supporting member 1 is in fluid communication with the concave portion 1*d,* while the other end is terminated in the opening 1*e*' at the left side of the supporting member 1, as described above. The other end 1*e*' of the passage 1*e* is connected to the first phase difference adjuster 9*a* by a pipe 12. The first phase difference adjuster 9*a* is identical with the foregoing one 9 and therefore an explanation thereof is omitted hereinbelow.

One end of the passage 1*h* formed in the supporting member 1 is in fluid communication with the concave portion 1*d*', while the other end is terminated in the opening 1*h*' at the left side of the supporting member 1, as described above. The other end of the passage 1*h* is connected to the second phase difference adjuster 9*b* by a pipe 512. The second phase difference adjuster 9*b* is identical with the foregoing one 9 and therefore an explanation thereof is omitted hereinbelow.

A second cold head 35 is mounted on the lower end 52*b* of the second regenerator 52, which is expected to cool a member (not shown) below a certain temperature. For establishing excellent heat transfer, the second cold head 32 is formed of copper which is of high heat conductivity. In the second cold head 35, a passage 351 is formed such that one end and the other end thereof are in fluid communication with the lower temperature end 52*b* of the second regenerator 52 and terminate in an opening 351 at an outer surface of the second cold head 35, respectively. The opening 351 is connected to one end of a second pipe 55. The other end of the second pipe 55 in fluid communication with the lower temperature end 54*b* of the second pulse tube 54 in such a manner that the second pulse tube 54 extends in the downward direction, passing though the hole 1*g* formed in the supporting member 1.

The hole 1*g* in the supporting member 1 is set to be sufficiently large in diameter so as not to be in contact with neither the pipe 5 nor the pipe 55 whenever both of the pipes 5 and 55 pass through the hole 1*g* concurrently. The reason is that a thermal contact for at least any one of the pipes 5 and 55 lowers the refrigerating efficiency of the pulse tube refrigerator 106.

It is to be noted that the lower side 1*b* of the supporting member 1 is connected with a vacuum heat insulated vessel 6, in which are enclosed the first pulse tube 4, the second pulse tube 54, the hole 1*g* formed in the supporting member 1, the pipe 5, and the pipe 55. These enclosed members are brought into heat insulated condition when the vessel 72 is evacuated.

When the pressure oscillation device 8 is operated, the working gas is oscillated in a system which consists of the pipe 11, the first regenerator 2, the second regenerator 52, the pipe 5, the pipe 55, the first pulse tube 4, the second pulse tube 4, the first second pulse tube 54, the first phase difference adjuster 12 and the second phase difference adjuster 512, thereby establishing a phase difference between the pressure oscillation and the displacement. Optimizing such a phase difference by the phase difference adjusters 9*a* and 9*b* establishes an adiabatic expansion and generates a subsequent coldness or a ultra low temperature at or near each of the mid-lower temperature end 4*b* of the first pulse tube 4 and the lower temperature end 54*b* of the second pulse tube 54.

As apparent from the illustration in FIG. 11, the mid-lower temperature end 4*b* of the first pulse tube 4 takes a lower position than the higher temperature end 4*b* of the first pulse tube 4. Due to the fact that the mid-lower temperature end 4*b* of the first pulse tube 4 is higher in temperature than the higher temperature end 4*a* of the first pulse tube 4, no free convection occurs in the first pulse tube 4. Similarly, the lower temperature end 54*b* of the second pulse tube 54 takes a lower position than the higher temperature end 54*a* of the second pulse tube 54. Due to the fact that the lower temperature end 54*b* of the second pulse tube 54 is higher in temperature than the higher temperature end 54*a* of the second pulse tube 54, no free convection occurs in the second pulse tube 54. Thus, in the pulse tube refrigerator 106, the refrigerating efficiency is not lowered.

As apparent from the foregoing description, the conceptual structure of the pulse tube refrigerator 106 of two stage type is made up of the supporting member 1 having an upper side 1*a* and a lower side 1*b,* the first pulse tube having at its opposite ends the higher temperature end 4*a* and the mid-lower temperature end 4*b,* the first regenerator 2 having at its opposite ends the higher temperature end 2*a* connected to the upper end 1*a* of the supporting member 1 and the mid-lower temperature end 2*b,* a first system defined between the first pulse tube 4 and the first regenerator 2, the pressure oscillation device 8 connected to the higher temperature end 2*a* of the first regenerator 2 for oscillating the working gas in the first system, the first phase difference adjuster 9*a* connected to the higher temperature end 4*a* of the first pulse tube 4 for adjusting the phase difference between the pressure oscillation and the displacement of the working gas in the first system, the first pipe 5 connecting the mid-lower end 4*b* of the first pulse tube 4 and the mid-lower temperature end 2*b* of the first regenerator 2, a second regenerator 52 having at its opposite ends the mid-lower temperature end 52*a* connected to the mid-lower temperature end 2*b* of the first regenerator 2 and the lower temperature end 52*b,* the second pulse tube 54 having at its opposite ends the higher temperature end 54*a* connected to the lower side 1*b* of the supporting member 1 and the lower temperature member 54*b,* and the second pipe 55 connecting the lower temperature end 54*b* of the second pulse tube 54 and the lower temperature end 52*b* of the second regenerator 52.

In the above-structured pulse tube refrigerator 106, the higher temperature end 4*a* of the first pulse tube 4 is held at the lower side 1*b* of the supporting member 1, which brings about a downward extension of the first pulse tube 4 which starts from the higher temperature end 4*a* and terminates in the mid-lower temperature end 4*b,* resulting in that the higher temperature end 4*a* takes a higher position than the mid-lower temperature end 4*b*. Due to the fact that the higher temperature end 4*a* is higher in temperature than the mid-lower temperature end 4*b,* no free convection of the working gas occurs in the first pulse tube 4. Similarly, the higher temperature end 54*a* of the second pulse tube 54 is held at the lower side 1*b* of the supporting member 1, which brings about a downward extension of the second pulse tube 54 which starts from the higher temperature end 54*a* and terminates in the mid-lower temperature end 54*b,* resulting in that the higher temperature end 54*a* takes a higher position than the mid-lower temperature end 54*b*. Due to the fact that the higher temperature end 54*a* is higher in temperature than the mid-lower temperature end 54*b,* no free convection of the working gas occurs in the second pulse tube 54.

As can be seen in the illustration of the FIG. 11, mounting the first cold head 34 and the second cold head 35 on the respective the mid-lower temperature end 2*b* of the first regenerator 2 and the lower temperature end 52*b* of the second regenerator 52 enables the connection of the cold head 35 with the member (not shown) from the bottom for cooling the same. In the resulting or contacted condition, the higher temperature end 4*a* of the first pulse tube 4 and the higher temperature end 54*a* are higher in position than the mid-lower temperature end 4*b* of the first pulse tube 4 and the lower temperature end 54*b* of the second pulse tube 54, respectively, with the result that no free convection of working gas occurs in each of the first pulse tube 4 and the second pulse tube 54.

If the pulse tube refrigerator 106 is required to mount the member (not shown) from the top, such a need can be satisfied by mounting the first cold head 34 and the second cold head 35 on the mid-lower temperature end 4*b* of the first pulse tube 4 and the lower temperature end 54*b* of the second pulse tube 54, respectively. Such a structure, though it is not illustrated, offers a higher position of the higher temperature end 4*a* of the first pulse tube 4 than the mid-lower temperature end 4*b* thereof as well as a similar higher position of the higher temperature end 54*a* of the second pulse tube 54 than the lower temperature end 54*b* thereof. Thus, no free convection of the working gas occurs in each of the first pulse tube 4 and the second pulse tube 54.

In the pulse tube refrigerator 106 in accordance with the fourth embodiment of the present invention, mounting the pulse tube refrigerator on the device can be attained from any one of the top and the bottom with the refrigerating efficiency unchanged.

Fifth Embodiment

Figure 12:
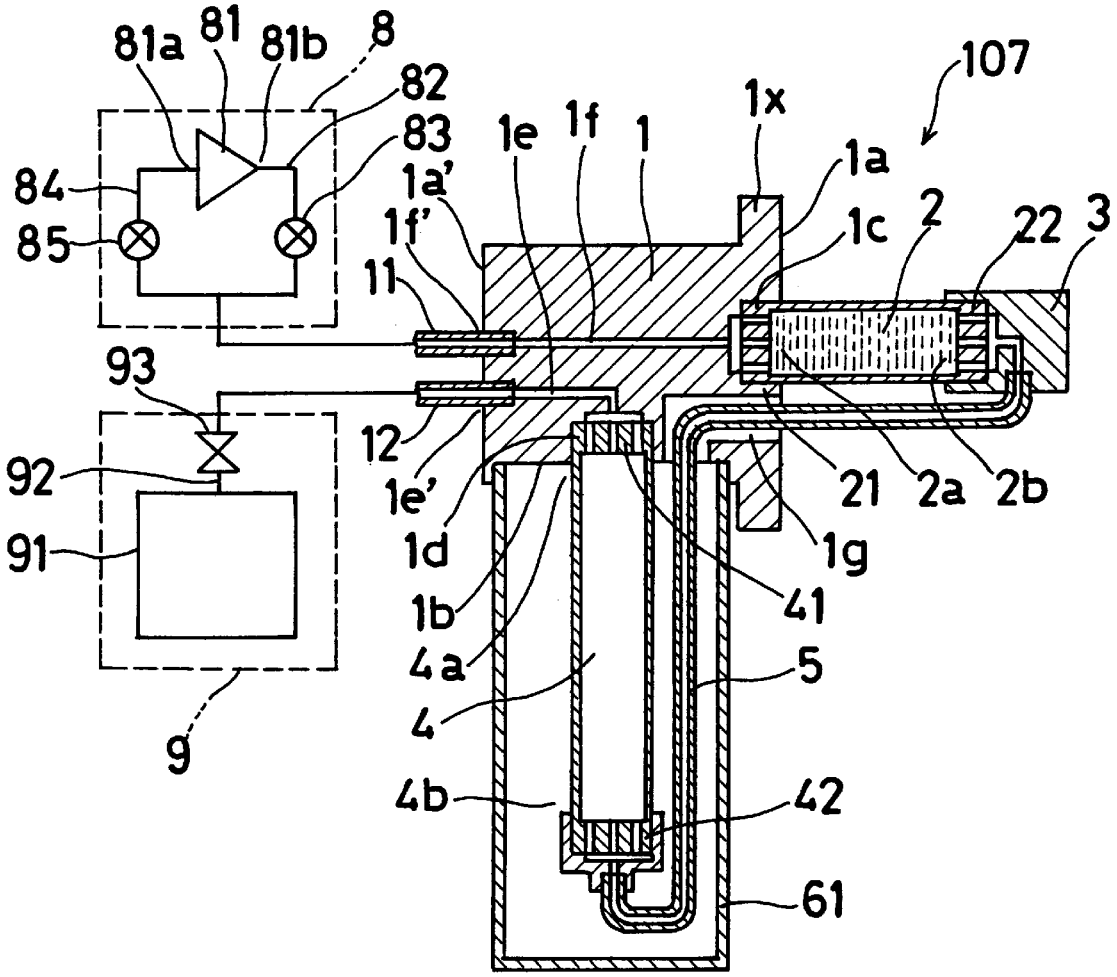
FIG. 12 is a partial vertical cross-sectional view of a fifth embodiment of a pulse tube refrigerator in accordance with the present invention.

Referring to FIG. 12, there is illustrated a pulse tube refrigerator 107 in accordance with a fourth embodiment of the present invention. The pulse tube refrigerator includes as its major elements a supporting member 1, a regenerator 2, a cold head 3, a pulse tube 4, a pipe 5, a pressure oscillation device 8 and a phase difference controller 9.

The supporting member 1 which is configured into a rectangular prism is formed of a metal such as copper, brass, or stainless steel. The supporting member 1 is provided at its right side 1*a* and lower side 1*b* with a concave portion 1*c* and a concave portion 1*d,* respectively. The supporting member 1 is also formed therein with a pulse tube passage 1*e* and a regenerator passage 1*f*. One end of the pulse tube passage 1*e* terminates in a bottom of the concave portion 1*d* in open manner and the other end terminates in an opening 1*e*' at a left side 1*a*' of the supporting member 1. One end of the regenerator passage 1*f* terminates in a bottom of the concave portion 1*c* in open manner and the other end terminates in an opening 1*f'* at the left side 1*a'* of the supporting member 1. A passing-through hole 1*g* which is of an inverted L-shaped shape is formed in the supporting member 1 between a right side 1*a* and the lower side 1*b*. At the right side 1*a* of the supporting member 1, there is formed a flange 1*x* integrally therewith.

It is to be noted that the supporting member 1 can be formed into one or more other configurations so long as they have a horizontal side and a lower side. For example, the supporting member 1 can be constituted from a column having an axial end and a flattened portion at a circumference of the column, to be equivalencies of the right side 1*a* and the lower side 1*b*.

The pulse tube 4 is formed into a hollow cylindrical member and includes at its opposite ends a first higher temperature end 4*a* having therein a flow adjuster 41 and a first lower temperature end 4*b* having therein a flow adjuster 42, respectively.

The first higher temperature end 4*a* of the pulse tube 4 is fitted in the concave portion 1*d* in the lower end 1*b* of the supporting member 1 and therefore the pulse tube 4 extends from the higher temperature end 4*a* to the lower temperature end 4*b* along the downward direction.

The regenerator 2 is configured into a hollow cylindrical member and includes at its opposite ends a second higher temperature end 2*a* and a second lower temperature end 2*b*, respectively. In the hollow cylindrical member, there is provided a heat retaining member which is in the form of a plurality of stacked meshed stainless steel members. Like the pulse tube 4, flow adjusters 21 and 22 are provided in the higher temperature end 4*a* and the lower temperature end 4*b* of the regenerator 2, respectively. The regenerator 2 is held by the supporting member 1 in such a manner that the higher temperature end 2*a* of the regenerator 2 is fitted in the concave portion 1*c* in the right side 1*a* of the supporting member 1.

One end and the other end of the regenerator passage 1*f* formed in the supporting member 1 are, as mentioned above, in fluid communication with the concave portion 1*c* and terminated in the opening 1*f'*. The opening 1*f'* is connected to the pressure oscillation device 8 via the pipe 11.

In this embodiment, the pressure oscillation device 8 includes, as its major components, a compressor 81 which operates for discharging an operating fluid or gas under a higher pressure from an outlet port 81*b* after sucking an operating fluid or gas under a lower pressure from an inlet port 81*a*, a higher pressure pipe 82 connected at one end thereof to the outlet port 81*b* of the compressor 81, a higher pressure valve 83 provided in a midway of the pipe 82, a lower pressure pipe 84 connected at one end thereof to the inlet port 81*a* of the compressor 81, and a lower pressure valve 85 provided in a midway of the pipe 84. The other end of the higher pressure pipe 82 and the other end of the lower pressure pipe 84 join together and the resultant junction is in fluid communication with the other end of the pipe 11. The higher pressure valve 83 and the lower pressure valve 85 are controlled to operate in opposition to each other and therefore when the higher pressure valve 83 and the lower pressure valve 85 are opened and closed, respectively, the higher pressure pipe 82 is in fluid communication with the pressure oscillation device 8, while when the higher pressure valve 83 and the lower pressure valve 85 are closed and opened, respectively, the lower pressure pipe 84 is in fluid communication with the pressure oscillation device 8.

The passage 1*e* formed in the supporting member 1 is, as previously mentioned, at its one end in fluid communication with the concave portion 1*d*. The other end of the passage 1*e* which terminates in the open end 1*e'* is in fluid communication with one end of a pipe 12 whose the other end is in fluid communication with the phase difference controller 9.

In this embodiment, the phase difference controller 9 includes, as its major components, a buffer tank 91 for storing a large amount of working gas by keeping the same at a determined pressure, a connecting pipe 92 whose one end is in fluid communication with the buffer tank 91, an orifice 93 disposed between the connecting pipe 92 and the pipe 12. The orifice 93 offers a fluid restriction to the working gas which moves between an interior of the pulse tube 4 and the buffer tank 91 due to a pressure difference therebetween, which results in a phase difference between a pressure oscillation and a displacement of the working gas. Such a phase difference is adjusted or optimized in order to generated coldness or a ultra low temperature.

The lower temperature end 4*b* of the pulse tube 4 is connected to the second lower temperature 2*b* of the regenerator 2 via the pipe 5 in such a manner that an outer surface of the pipe 5 is out of thermal contact with an inner side of the hole 1*g* of the supporting member 1. The reason is that contacting the pipe 5 with the supporting member 1 causes a heat transfer from the former to the latter, resulting in that the refrigerating efficiency of the pulse tube refrigerator 107 drops.

Figure 13:
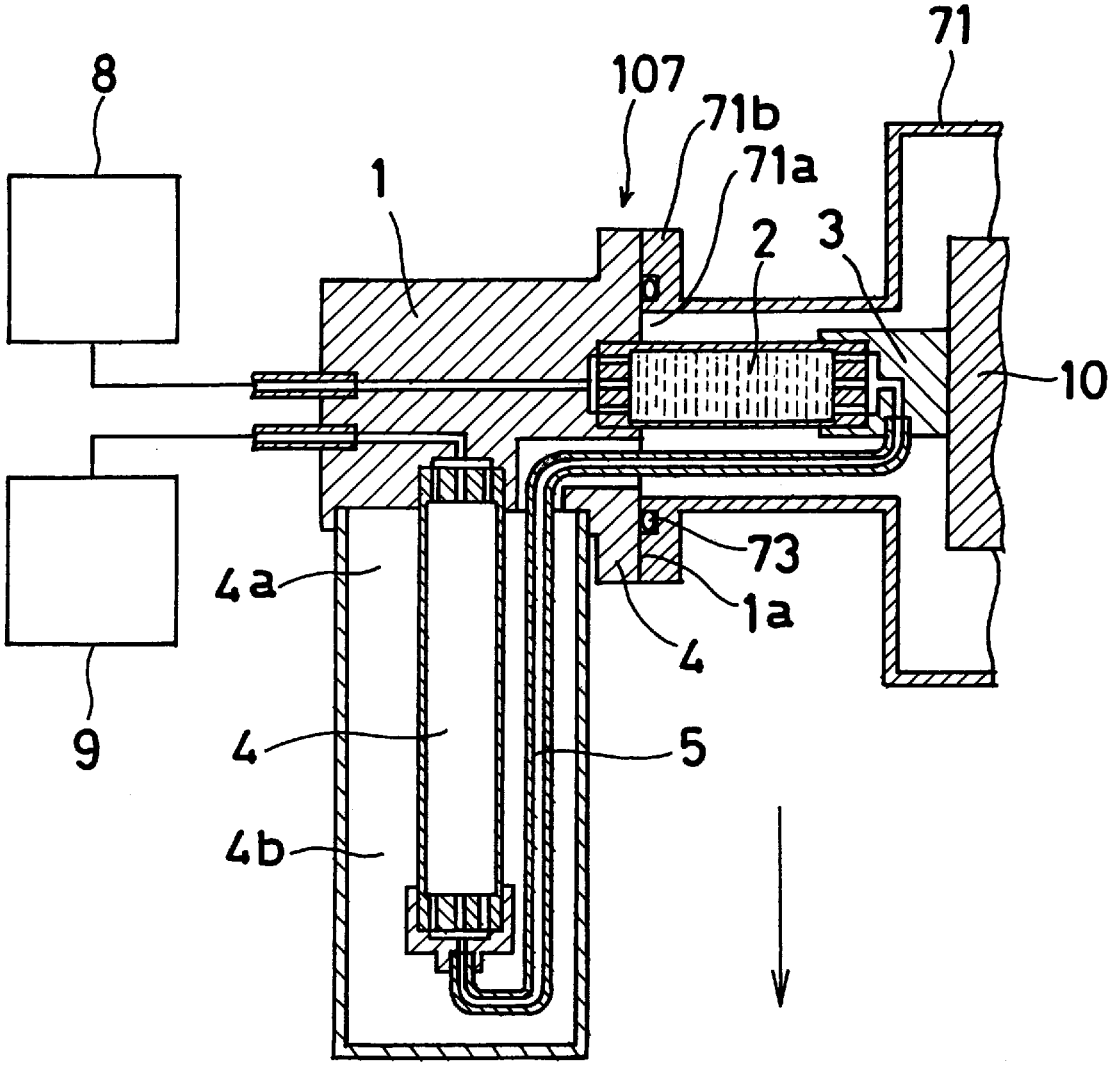
FIG. 13 is a view showing how the pulse tube refrigerator shown in FIG. 12 is brought into thermal connection to a member in a device from the left.

A cold head 3 is mounted on the second lower temperature end 2*b* of the regenerator 2. The cold head 3 is expected to cool a member 10 (FIG. 13) below a determined temperature. For establishing maximum heat transfer from the second lower temperature end 2*b* of the regenerator 2 to the member 10, the cold head 3 is formed of copper of excellent heat conductivity. Such an arrangement of the cold head 3 offers a rightward projection of the cold head 3 from the supporting member 1.

It is to be noted that the lower side 1*b* of the supporting member 1 is connected with a vacuum heat insulating vessel 61 so as to enclose therein the pulse tube 4, a lower end of the hole 1*g* formed in the supporting member 1, and the pipe 5. When the vessel 61 is evacuated, an interior of the vessel 61 is brought into a vacuum condition, thereby establishing heatinsulation of each of the members in the vessel 61 from the outside.

In operation, the higher pressure valve 83 and the lower pressure valve 85 make repetitive operations in opposition as previously mentioned while the compressor 81 of the pressure oscillation device 8 runs, a pressure oscillation occurs in the working gas of a pulse refrigerating system constituted by the pipe 1*f*, the regenerator 2, the connecting pipe 5, the pulse tube 4, and the pipe 1*e*. A phase difference is established between the pressure oscillation and the displacement of the working gas via the flow restriction at the orifice 93 while the working gas is in reciprocal movement between the buffer tank 91 of the phase difference controller 9 and the pulse refrigerating system. Optimizing the phase difference by controlling the orifice 93 causes an adiabatic expansion of the working gas in the vicinity of the first lower temperature end 4*b*, which results in a generation of coldness or a ultra low temperature thereat. The resultant coldness is fed or transferred via the pipe 5 to the second lower temperature end 2*b* of the regenerator and the cold head 3. Thus, the cold head 3 is cooled down.

Figure 14:
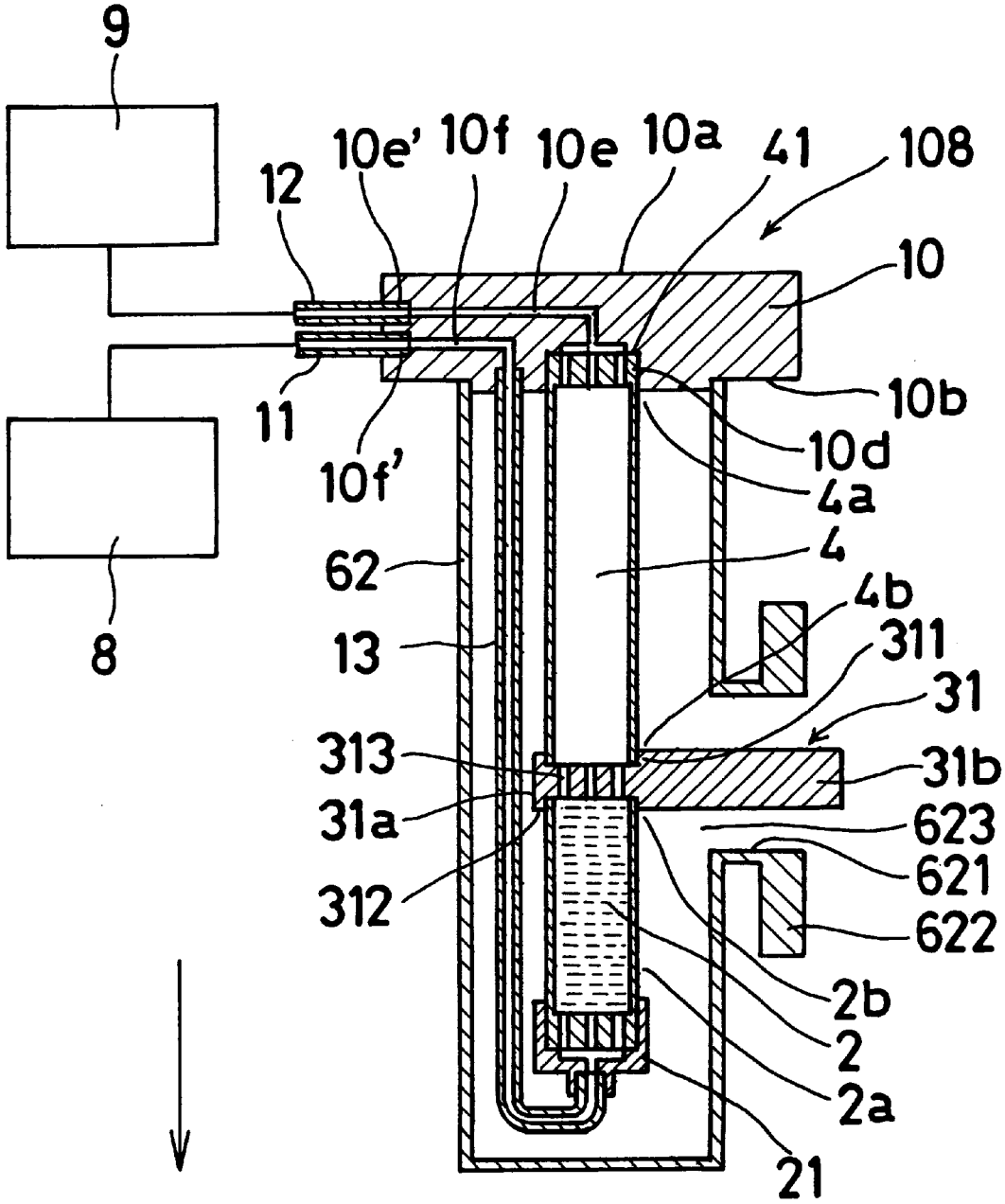
FIG. 14 is a partial vertical cross-sectional view of a sixth embodiment of a pulse tube frigerator in accordance with the present invention.

Referring next to FIG. 14, this figure shows how the pulse tube refrigerator 106 cools the member 10 accommodated in a vacuum vessel 71. The vessel 71 has an opening 71*a* at its left side. A flange 71*b* is formed around the opening 71*a* integrally with the left side of the vessel 71. The flange 71*b* of the vessel 71 is secured to the flange 1*x* at the right side 1*a* of the supporting member 1 with a seal packing member 73 interposed between the flanges 71*b* and 1*x* for fluid-tight connection therebetween, the resultant arrangement is secured together by a bolt passing through the members 71*b*, 73, and 1*x*. After establishing such an arrangement, if the pulse tube refrigerator 106 is operated subsequent to the vacuumed condition thereof, the member 10 is cooled by the cold head 3.

In the above-structured pulse tube refrigerator 107, the higher temperature end 4*a* of the first pulse tube 4 is held at the lower side 1*b* of the supporting member 1, which brings about a downward extension of the first pulse tube 4 which starts from the higher temperature end 4*a* and terminates in the lower temperature end 4*b*, resulting in that the higher temperature end 4*a* takes a higher position than the lower temperature end 4*b*. Due to the fact that the higher temperature end 4*a* is higher in temperature than the lower temperature end 4*b*, no free convection of the working gas occurs in the first pulse tube 4.

In addition, the second higher temperature end 2*a* of the regenerator 2 is held to the right side 1*a* of the supporting member 1, which results in a rightward extension of the regenerator 2 which starts from the second higher temperature end 2*a* and terminates in the second lower temperature end 2*b*. Mounting the cold head 3 on the lower temperature end 2*b* of the regenerator 2 brings about a rightward projected positioning of the cold head 3, and such an arrangement of the cold head 3 enables a thermal contact of the cold head 3 with the member 10 from the left side.

It is to be noted a cold head (not shown) of another device which is in symmetric with the device 107 can be brought into contact with the member 10 from the right side.

In addition, the extension of the connecting pipe 5 through the hole 1*g* which is formed in the supporting member 1 in an inverted L-shaped configuration enables a minimum occupying space of the pulse tube refrigerator 107 to be as small as possible.

Sixth Embodiment

Referring to FIG. 14, this Figure shows a pulse tube refrigerator 108 in accordance with a sixth embodiment of the present invention. The pulse tube refrigerator 108 is a modification of the refrigerator 103 and therefore same reference numbers are assigned to the same elements as in the second embodiment, which means that no description has been made regarding the same elements and different parts only are explained hereinafter. In FIG. 14, a cold head 31 is interposed between the first lower temperature end 4*b* of the pulse tube 4 and the second lower temperature end 2*b* of the regenerator 2. The cold head 31, which is formed in a one piece configuration, is divided into a first portion 31*a* and a second portion 31*b*. In an upper side and a lower side of the first portion 31*a*, a concave portion 311 and a concave portion 312 are provided, respectively. The first lower temperature end 4*b* of the pulse tube 4 and the second lower temperature end 2*b* of the regenerator 2 are received in the concave portion 311 and the concave portion 312, respectively. A fluid communication between the first lower temperature end 4*b* of the pulse tube 4 and the second lower temperature end 2*b* of the regenerator 2 is established by a passage 313 so formed in the first portion 31*a* as to pass therethrough. The first portion 31 of the cold head 31 is expected to receive coldness or an ultra low temperature generated at the lower temperature end 4*b* of the pulse tube 4. The cold head 31 extends in the rightward direction through an opening 623 and terminates in the second portion 31*b*. The second portion 31*b* of the cold head 31 is used to cool a member 10 (FIG. 15) below a determined temperature by being contacted therewith.

An operation of the pulse tube refrigerator 104 is omitted due to the fact it is identical with the operation of the pulse tube refrigerator 103 shown in FIG. 5.

Figure 15:
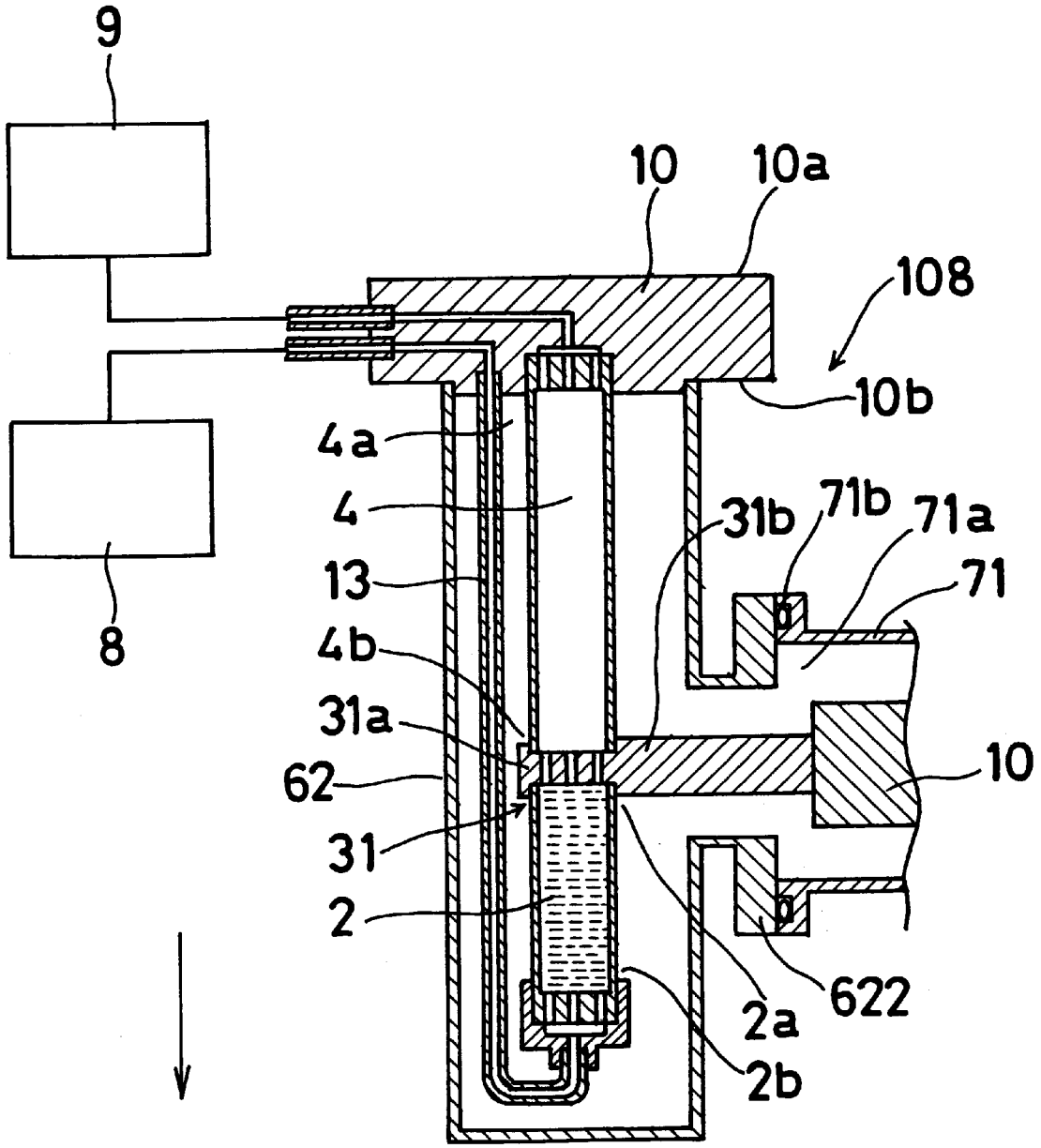
FIG. 15 is a view showing how the pulse tube refrigerator shown in FIG. 14 is brought into thermal connection to a member in a device from the left.

Referring next to FIG. 15, this figure shows how the pulse tube refrigerator 108 cools the member 10 below a determined temperature, which member is accommodated in a vacuum pan or vessel 71 in a heat insulated condition. The vacuum vessel 71 is formed at its left end with an installing hole 71*a*. After the left end of the vacuum vessel 71 is mounted on the flange 622 of the vacuum heat-insulating vessel of the pulse tube refrigerator 108 in such a manner that a seal packing 73 is disposed for fluid-tight relationship therebetween, passing a connecting device such as a bolt (not shown) through the flange 71*b* establishes a rigid connection between the vacuum vessel 71 and the pulse tube refrigerator 108. After such a connection is established, evacuating the vessel 62 brings about a heat insulating condition of each of the regenerator 2, the pipe 5, the cold head 31, the pulse tube 4, and related elements and the member 10 which is in contact with the second cold head portion 31*b* of the cold head 31 within the vacuum vessel 71 is brought into a cooled condition at the ultra low temperature.

As can be understood easily from the depiction of FIG. 15, the first lower temperature end 4*b* of the pulse tube 4 is placed a lower position than the first higher temperature end 4*a*. In light of the fact that the first higher temperature end 4*a* is higher in temperature than the lower temperature end 4*b*, such an arrangement means that no free convection of the working gas in the pulse tube 4 is generated, which would cause a lowering of the refrigerating efficiency.

Seventh Embodiment

Figure 16:
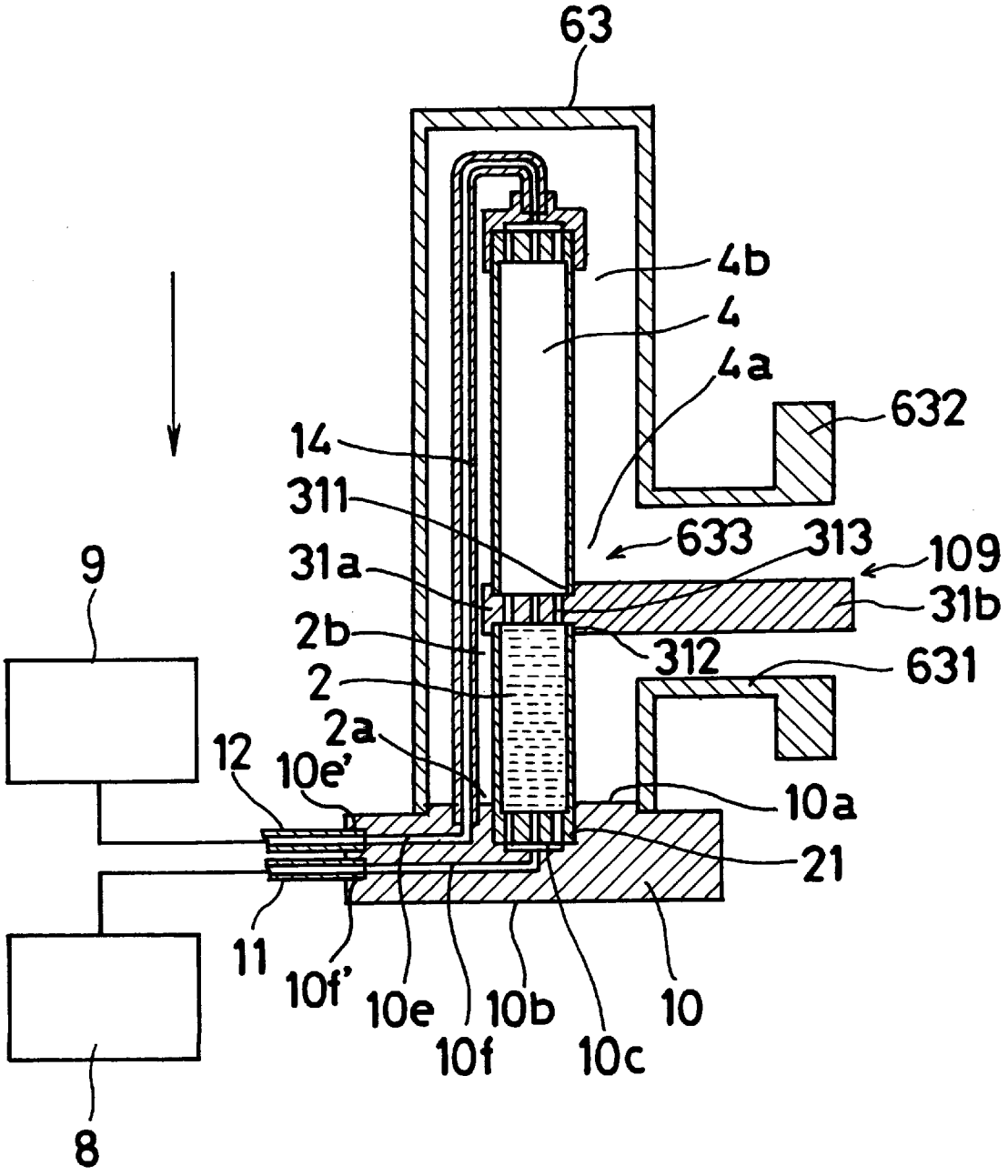
FIG. 16 is a partial vertical cross-sectional view of a seventh embodiment of a pulse tube refrigerator in accordance with the present invention.

Referring to FIG. 16, a pulse tube refrigerator 109 includes, as its major elements, a supporting member 10, a pulse tube 4, a regenerator 2, a pressure oscillation device 8, a phase difference controller 9, and a cold head 31.

The supporting member 10 is in the form of an annular member formed of a metal such as copper, brass, a stainless steel or other similar material and has an upper end 10*a* and a lower end 10*b*. At the upper side 1*a* of the supporting member 10, there is formed a concave potion 10*c* for a mounting of the regenerator 2. In the supporting member 10, there is formed a pulse tube passage 10*e* and a regenerator passage 10*f*. One end and the other end of the passage 10*e* respectively terminate in the upper side 10*a* of the member 10 in open manner for being in fluid communication with a pipe 14 and in an opening 10*e*' at a left side of the supporting member 10. One end and the other end of the passage 10*f* respectively terminate in a bottom of the concave portion 10*c* in open manner and in an opening 10*f*' at the left side of the supporting member 10.

The pulse tube 4 is formed into a hollow cylindrical body which has at opposite ends thereof a first higher temperature end 4*a* and a first lower temperature end 4*b*, respectively. At the first higher temperature end 4*a* of the pulse tube 4, there is provided a flow adjuster 41.

The regenerator 2 is so configured as to be a hollow cylindrical body having at opposite ends thereof a second higher temperature end 2*a* and a second lower temperature end 2*b*, respectively. Within the cylindrical body, there is provided a heat retaining member which is in the form of a plurality of stacked meshed metal sheets of stainless steel. The regenerator 2 is held at the supporting member 10 such that the second higher temperature end 2*a* is fitted in the concave portion 10*c* in the upper side 10*a* of the higher temperature member 10 and the second lower temperature end 2*b* is in fluid communication with the first lower temperature end 4*b* end of the pulse tube 4.

Between the first lower temperature end 4*b* of the pulse tube 4 and the second temperature end 2*b* of the regenerator 2, there is interposed a cold head 31. The cold head 31 is formed in a one-piece configuration having a first cold portion 31*a* and a second portion 31*b*. The first cold head portion 31*a* of the cold head 31 is expected to receive coldness or an ultra low temperature generated at the first lower temperature end 4*b* of the pulse tube 4 by being held between the lower temperature ends 2*b* and 4*b*. The cold head 31 extends in the rightward direction. Such an extension of the cold head 31 starts from the first portion 31*a*, passes though an opening 631 surrounded by a flange 632 of a vacuum heat insulating vessel 63, and terminates in the second portion outside the vessel 63.

The second portion 31*b* of the cold head 31 is in contact with a member (not shown) for cooling the same below a determined temperature. The cold head 31 having this construction is formed of copper which is excellent in heat transfer for establishing excellent refrigerating efficiency. It is to be noted that the cold head 31 can be obtained by assembling separated first portion 31*a* and the second portion 31*b* into the foregoing one-piece structure.

In the first cold head portion 31*a* of the cold head 31, there is formed a passage (not referenced) for establishing a fluid communication between the lower temperature ends 4*b* and 2*b*.

One end of the passage 1*f* which is formed in the supporting member 10 is in fluid communication with the concave portion 10*c* and the other end of the passage 10*f* is terminated in the opening 1*f*' at the left side of the supporting member 10, as described above. The opening 10*f*' is connected with one end of a pipe 11 whose the other end is connected to the pressure oscillation device 8. The pressure oscillation device 8 is identical with one of the first embodiment of the pulse tube refrigerator in construction and operation and therefore further explanation of the pressure oscillation device 8 is omitted.

One end of the passage 10*e* which is formed in the supporting member 10 opens at the upper side 10*a* of the supporting member 10 for being in fluid communication with the pipe 14 and the other end of the passage 10*e* terminates in the opening 10*e*' at the left side of the supporting member 10, as previously explained. The opening 10*e*' is connected via a pipe 12 to the phase difference controller 9. It is to be noted that the phase difference controller 9 is identical with that in the first embodiment of the pulse tube refrigerator 101 in construction and operation and therefore further explanation related to the phase difference controller 9 is omitted.

One end and the other end of the pipe 14 are opened at the upper side 10*a* of the supporting member 10 and are in fluid communication with the first higher temperature end 4*a* of the pulse tube 4. Thus, the first higher temperature end 4*a* of the pulse tube 4 is brought into fluid communication with the phase difference controller 9 via the pipe 14, the passage 10*e*, and the pipe 12.

When the pressure oscillation device 8 is brought into operation, a working gas filled in the system is varied in pressure, which system is constituted by a continuous connection of the passage 11, the regenerator 2, the pulse tube 4, the pipe 14 and the pipe 12. This results in a phase difference between a pressure oscillation and a displacement in the working gas. Optimizing such a phase difference causes an adiabatic expansion of the working gas at-and-near the first lower temperature end 4*b* of the pulse tube 4, resulting in a generation of coldness or an ultra low temperature in this region.

The resulting coldness or ultra low temperature generated at the is transmitted to the second portion 31*b* of the cold head 31 for cooling the member after contacting the second portion 31*b* of the cold head 31 with the member from the left.

The invention has thus been shown and description with reference to specific embodiments, however, it should be understood that the invention is in no way limited to the details of the illustrates structures but changes and modifications may be made without departing from the scope of the appended claims.

What is claimed is:

1. A pulse tube refrigerator comprising a pulse tube having at its opposite ends a first higher temperature end and a first lower temperature end, respectively;

a regenerator having at its opposite ends a second higher temperature end and a second lower temperature end connected to the first lower temperature end of the pulse tube, respectively, the regenerator being arranged out of parallel to the pulse tube;

a pressure oscillation device connected to the second higher temperature end of the regenerator for oscillating the working gas;

a phase difference controller connected to the first higher temperature end of the pulse tube and controlling a phase difference between a pressure oscillation and a displacement of the working gas; and a cold head which is in thermal coupling with the first lower temperature end of the pulse tube.

2. A pulse tube refrigerator as set forth in claim 1 further comprising a base member which is of a substantial higher temperature, wherein the first higher temperature end of the pulse tube is held on a lower side of the base member so as to extend in the downward direction, the second higher temperature end of the regenerator is held on an upper side of the base member so as to extend in the upward direction, a pipe passes through a hole formed in the base member and establishes a fluid communication between the first lower temperature end of the pulse tube and the second lower temperature end of the regenerator, and the cold head is mounted on the second lower temperature end of the regenerator.

3. A pulse tube refrigerator as set forth in claim 1 further comprising a base member which is of a substantial higher temperature, wherein the first higher temperature end of the pulse tube is held on a lower side of the base member so as to extend in the downward direction, the second higher, temperature end of the regenerator is held on an upper side of the base member so as to extend in the upward direction, a pipe passes through a hole formed in the base member and establishes a fluid communication between the first lower temperature end of the pulse tube and the second lower temperature end of the regenerator, and the cold head is mounted on the first lower temperature end of the pulse tube.

4. A pulse tube refrigerator as set forth in claim 1 further comprising a base member which is of a substantial higher temperature, wherein the first higher temperature end of the pulse tube is held on the lower side of the base member so as to extend in the downward direction, the regenerator is in series with the pulse tube such that the first lower temperature end thereof is connected to the second lower temperature-end of the regenerator, the second higher temperature end of the regenerator is in thermal connection with the base member via a pipe connecting the pressure oscillation device and the regenerator, the cold head is held between the first lower temperature end of the pulse tube and the second lower temperature end of the regenerator and extends upwardly so as to terminate above the upper side of the base member.

5. A pulse tube refrigerator as set forth in claim 1 further comprising a base member which is of a substantial higher temperature, wherein the first higher temperature end of the pulse tube is held on a lower side of the base member so as to extend in the downward direction, the second temperature end of the regenerator is connected to the first lower temperature end of the pulse tube so that the regenerator extends in the downward direction and terminates in its second higher temperature end, and the cold head is held between the first lower temperature end of the pulse tube and the second lower temperature end of the regenerator and extends downward so as to terminate below the second higher temperature end of the regenerator.

6. A pulse tube refrigerator as set forth in claim 1 further comprising a base member which is of a substantial higher temperature, wherein the second higher temperature end of the regenerator is held on an upper side of the base member so as to extend upwardly, the pulse tube is in series with the regenerator tube and terminates in its second higher, temperature end, and the cold head is held between the first lower temperature end of the pulse tube and the second lower temperature end of the regenerator and extends upwardly so as to terminate above the first higher temperature end of the pulse tube.

7. A pulse tube refrigerator as set forth in claim 1 further comprising a base member which is of a substantial higher temperature, wherein the first higher temperature end of the pulse tube is held on a lower side of the base member so as to extend in the downward direction, the second higher temperature end of the regenerator is held on a horizontal side of the base member so as to extend in the horizontal direction, a pipe passes through a hole formed in the base member and establishes a fluid communication between the first lower temperature end of the pulse tube and the second lower temperature end of the regenerator, and the cold head is mounted on the second lower temperature end of the regenerator.

8. A pulse tube refrigerator as set forth in claim 1 further comprising a base member which is of a substantial higher temperature, wherein the first higher temperature end of the pulse tube is held on a lower side of the base member so as to extend in the downward direction, the regenerator is in series with the pulse tube and terminates in its second temperature end, and the cold head is held between the first lower temperature end of the pulse tube and the second lower temperature end of the regenerator and extends in the horizontal direction.

9. A pulse tube refrigerator as set forth in claim 1 further comprising a base member which is of a substantial higher temperature, wherein the second higher temperature end of the regenerator is held on an upper side of the base member so as to extend upwardly, the pulse tube is in series with the regenerator and terminates in its first higher temperature end, and the cold head is held between the first lower temperature end of the pulse tube and the second lower temperature end of the regenerator and extends in the horizontal direction.

10. A pulse tube refrigerator having a pressure oscillation device, a phase difference controller and a cold head, comprising:

a supporting member having one side and an other side;

a pulse tube having at opposite ends thereof a first higher temperature end connected to the one side of the supporting member, and a first lower temperature end, respectively;

a regenerator having at opposite ends thereof a second higher temperature end connected to the other side of the supporting member and a second lower temperature end; and a connecting pipe connected between the first lower temperature end and the second lower temperature end.

11. A pulse tube refrigerator as set forth in claim 10, wherein the one side of the supporting member is a lower side and the other side of the supporting member is an upper side.

12. A pulse tube refrigerator as set forth in claim 11, wherein the higher temperature member is formed therein with a hole such that the hole passes through the higher temperature member in the vertical direction and receives the connecting pipe without contact with each other.

13. A pulse tube refrigerator as set forth in claim 10, wherein the one side of the supporting member is a lower side and the other side of the supporting member is a horizontal side.

14. A pulse tube refrigerator as set forth in claim 13, wherein a hole is formed in the higher temperature block so as to connect the lower side and the horizontal side, the connecting, pipe passes through the hole without thermal contact with the higher temperature block.

15. A pulse tube refrigerator having a pressure oscillation device and a phase difference controller, comprising:

a pulse tube having at opposite ends thereof a first higher temperature end held at a supporting member and a first lower temperature end, respectively;

a regenerator having at opposite ends thereof a second higher temperature end and a second lower temperature end which is in fluid communication with the first lower temperature end of the pulse tube, respectively;

a cold head having a first cold head portion held between the first lower temperature end of the pulse tube and the second lower temperature end of the regenerator and a second cold head portion provided at a location remote from the first cold head portion and thermally coupled to the first cold head portion.

16. A pulse tube refrigerator as set forth in claim 15, wherein the supporting member has a lower side and the higher temperature end of the pulse tube is connected to the lower side of the supporting member.

17. A pulse tube refrigerator as set forth in claim 16, wherein the supporting member has an upper side and a second cold head portion is located over the upper side of the supporting member.

18. A pulse tube refrigerator as set forth in claim 16, wherein the second cold head portion is located under the second higher temperature end of the regenerator.

19. A pulse tube refrigerator as set forth in claim 16, wherein the second cold head portion is located over the first higher temperature end of the pulse tube.

20. A pulse tube refrigerator as set forth in claim 16, wherein the second cold head portion extends from the first cold head portion in the horizontal direction.

21. A pulse tube refrigerator as set forth in claim 15, wherein the supporting member has an upper side and the higher temperature end of the regenerator is connected to the upper side of the supporting member.

22. A pulse tube refrigerator as set forth in claim 21, wherein the second cold head portion extends from the first cold head portion in the horizontal direction.

23. A pulse tube refrigerator having a pressure oscillation device, comprising:

a supporting member having one side and an other side;

a first pulse tube having at opposite ends thereof a higher temperature end connected to the one side of the supporting member, and a mid-lower temperature end, respectively;

a second pulse tube having at opposite ends thereof a higher temperature end connected to the one side of the supporting member, and a lower temperature end, respectively;

a first regenerator having at opposite ends thereof a higher temperature end connected to the other side of the supporting member and a mid-lower temperature end, respectively;

a second regenerator having at opposite ends thereof a mid-lower temperature end connected to the mid-lower temperature end of the first regenerator and lower temperature end, respectively;

a first connecting pipe connected between the mid-lower temperature end of the first pulse tube and the mid-lower temperature end of the first regenerator; and a second connecting pipe connected between the lower temperature end of the second pulse tube and the lower temperature end of the second regenerator.

24. A pulse tube refrigerator as set forth in claim 23, wherein the one side of the supporting member is a lower side and the other side of the supporting member is an upper side.

25. A pulse tube refrigerator as set forth in claim 24, wherein the supporting member is formed therein with a hole such that the hole passes through the supporting member in the vertical direction and receives the first connecting pipe and the second connecting pipe without contact with each other.

* * * * *